US006592413B2

(12) United States Patent
Simard et al.

(10) Patent No.: US 6,592,413 B2
(45) Date of Patent: Jul. 15, 2003

(54) THRUST-REVERSING NOZZLE ASSEMBLY FOR WATERCRAFT

(75) Inventors: Richard Simard, St-Charles-de-Drummond (CA); Ėric Mėnard, Rock Forest (CA); Normand Beauregard, Valcourt (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 09/942,727

(22) Filed: Aug. 31, 2001

(65) Prior Publication Data

US 2002/0028614 A1 Mar. 7, 2002

Related U.S. Application Data

(60) Provisional application No. 60/229,341, filed on Sep. 1, 2000.

(51) Int. Cl.[7] ..... B63H 11/11
(52) U.S. Cl. ..... 440/41
(58) Field of Search ..... 440/40–42

(56) References Cited

U.S. PATENT DOCUMENTS 3,756,185 A * 9/1973 Breslin ..... 440/42
3,906,885 A * 9/1975 Woodfill ..... 440/42
6,267,633 B1 7/2001 Suganuma

OTHER PUBLICATIONS

Bombardier "Sea–Doo," Parts Catalog 1999, GTX Limited 5888/5889, p. C10 to D1, D11 and D12, Jan. 1999.
Bombardier "Sea–Doo," Parts Catalog 2000, RX DI 5646/5656, P. C7, C8, C10 and C11, Apr. 2000.
www.berkeleyjet.com, copyright 1999.
www.hamiltonjet.com.

* cited by examiner

*Primary Examiner*—Ed Swinehart
(74) *Attorney, Agent, or Firm*—Pillsbury Winthrop LLP

(57) ABSTRACT

The invention provides an improved nozzle assembly for waterjet-propelled watercraft such as a personal watercraft. In particular, the invention features an improved reverse gate assembly used to travel in a reverse direction. The reverse gate is linked to the steering-controlling waterjet outlet nozzle and pivots laterally with it to provide significantly enhanced steering response and control when the reverse gate is extended for reverse direction travel of the watercraft. The reverse gate actuation linkage assembly enables such linkage of the reverse gate and the steering-control nozzle member even when the nozzle is configured to pivot vertically (in addition to laterally) to "trim" the attitude of the watercraft in the water. Differential or laterally asymmetric design of the reverse gate compensates for vorticity or swirl in the waterjet to help ensure uniform watercraft performance when travelling in a reverse direction and turning either to the right or to the left.

10 Claims, 19 Drawing Sheets

THRUST-REVERSING NOZZLE ASSEMBLY FOR WATERCRAFT

This application claims priority from and the benefit of provisional application Ser. No. 60/229,341 filed Sep. 1, 2000.

FIELD OF THE INVENTION

The invention relates to a thrust-reversing nozzle assembly for a watercraft and, in particular, for a jet-propelled watercraft such as a sport boat or a personal watercraft.

BACKGROUND OF THE INVENTION

As shown in FIG. 1, a personal watercraft 10 has a hull 12, a seat 14 configured to support up to four riders, and a steering control mechanism 16 (e.g., handlebars) with which the operator steers the watercraft. Typically, a personal watercraft is propelled by a waterjet thrust system, with the thrust-producing jet of water being expelled at relatively high velocity from a nozzle assembly 18 mounted at the rear of the watercraft 10. A thrust-directing nozzle member 22 is laterally pivotally mounted in the assembly so as to swing left and right (about a vertically oriented axis), which directs the jet of water left or right and causes the watercraft to turn in the same direction. In some cases, the nozzle member 22 may also be mounted so as to pivot vertically slightly up and down (about a horizontally oriented axis), thereby enabling the "attitude" of the watercraft within the water to be adjusted or "trimmed." When the steering control mechanism 16 is turned, an interconnected steering linkage 24 pushes and pulls on steering armature 26, which is connected to (e.g., integral with) the nozzle member 22, thereby effecting lateral pivoting of the nozzle member 22 and hence turning of the watercraft.

As shown in FIGS. 2A and 2B, a retractable reverse gate 30 (not shown in FIG. 1 for clarity) is attached to the rear portion of the hull of the watercraft and swings vertically between 1) a stowed or retracted position, shown in FIG. 2A, in which it is "tucked" partially within the "pocket" or "tunnel" 20 formed by the rear portion of the hull (see FIG. 1) and in which the nozzle assembly 18 is mounted; and 2) a lowered or extended position, shown in FIG. 2B. In the stowed or retracted position (FIG. 2A), the reverse gate is held out of the way of the propulsive jet of water being expelled from the nozzle assembly 18, and therefore it does not affect the direction of travel of the watercraft. When it is desired to reverse the direction of travel, i.e., to back up, the reverse gate 30 is lowered (e.g., by pulling or pushing a reverse lever (not shown) that is accessible to the operator) by means of reverse gate linkage 31 into position behind the nozzle assembly 18, as shown in FIG. 2B. The reverse gate 30 has a "shell" configuration, with generally hemispherical or quarter-spherical inner surfaces over each of the portions 30*a* and 30*b*. Accordingly, when the water jet being expelled from the nozzle assembly strikes the inner surfaces of the reverse gate, it is deflected or turned so as to be expelled forwardly from the reverse gate, thereby effecting reverse movement of the watercraft.

As further illustrated in FIG. 2B, the nozzle member 22 typically is mounted (either directly or via a gimbal system to allow vertical, trim pivoting as well as lateral, steering pivoting) over the exit end of a flow-accelerating venturi member 28 having a narrowing, flow-accelerating interior passage that accelerates the jet of water. The venturi member 28, in turn, is mounted (e.g., bolted) to impeller housing 32, which is secured (e.g., bolted) to the pump support of the watercraft. A waterjet-producing impeller and the shaft which spins it are housed within and extend through the impeller housing 32, respectively.

What we have observed, however, is that the operator of the watercraft typically does not have the same level of directional control when travelling in a reverse direction as when travelling in a forward direction. In fact, it has been observed that, depending upon the desired radius of a reverse-direction turn, a "cross-control" situation can arise in which the watercraft actually turns in the direction opposite to that in which it is desired to travel as the jet of water is deflected back not along the axis of the nozzle, but rather at a complementary angle to it. Additionally, we have found that in the prior art, if the nozzle member is vertically pivotable for adjusting the "trim" of the watercraft, acceptable reverse travelling performance has not been obtained because changing the trim angle of the nozzle can cause 1) the reverse gate to be blown back up to the retracted position by the waterjet; 2) the waterjet to pass completely over the top of the reverse gate; 3) the waterjet to strike the reverse gate too far down on the inner surface to be diverted correctly; or otherwise to be misdirected. Accordingly, there exists a need in the art for an improved reversing assembly for use in waterjet-propelled watercraft such as a personal watercraft, particularly in such waterjet-propelled watercraft in which the nozzle member is capable of pivoting vertically as well as laterally for "trimming" the attitude of the watercraft in the water.

SUMMARY OF THE INVENTION

The present invention overcomes the limitations of the prior art described above and therefore meets this need. In particular, the invention features an improved reverse gate assembly in which the reverse gate is linked to the thrust-directing nozzle member so as to pivot laterally with it (i.e., left and right about a vertically oriented axis), particularly while permitting vertical (i.e., up and down about a horizontally oriented axis), trim-adjusting pivoting of the nozzle (which trim-adjusting pivoting causes the axis about which the reverse gate pivots to move in a vertical direction). This ensures that the net effect of the reversed flow of the waterjet is a reversing thrust force that is oriented substantially along the direction of the axis of the nozzle member; as the nozzle member pivots with steering inputs, the reverse gate also pivots so as to maintain that substantial alignment. Thus, steering sensitivity and control when travelling in the reverse direction are significantly improved as compared to the prior art.

In a first aspect, the invention features a nozzle assembly which is capable of reversing the traveling direction of a waterjet-propelled watercraft. The nozzle assembly includes a nozzle member that is configured to be connected to a rear portion of the watercraft, with the nozzle member being both laterally pivotable with respect to the watercraft (for steering control) and vertically pivotable with respect to the watercraft (to adjust the "trim" or the attitude of the watercraft in the body of water in which it sits). The nozzle assembly further includes a laterally pivotable, retractible reverse gate that is linked to the nozzle member so as to pivot laterally with it. The reverse gate is movable between a stowed position and a thrust-reversing position in which it redirects a jet of water expelled from the nozzle member so as to reverse the traveling direction of the watercraft. (The reverse gate can also be held in a "neutral" position (which requires the operator to hold the actuating lever in a mid-position, between a reverse gate-stowed position and a reverse gate-extended position), in which "neutral" position the reverse gate deflects water straight downward so that the watercraft does not move forward or backward, e.g., when idling.) By being linked to the nozzle member so as to pivot laterally with it, the reverse gate always redirects the jet of water in the same direction relative to the nozzle member, i.e., in a direction such that the net thrust acts in a reversing direction.

In preferred embodiments of the nozzle assembly, the reverse gate is pivotally attached directly to the nozzle member and pivots vertically with respect to it. The nozzle assembly may include a flow-accelerating venturi member that is configured to be connected to the rear portion of the watercraft, or the nozzle assembly may be a retrofit assembly that is configured to be attached to a flow-accelerating venturi member that is already connected to the rear portion of the watercraft.

Preferably, the nozzle assembly is gimbaled, e.g., by mounting the nozzle member in a trim ring so as to pivot laterally within the trim ring and by having the trim ring configured to be mounted to the venturi member so as to pivot vertically relative to the venturi member, thereby enabling the nozzle member to pivot both laterally (for steering control) and vertically (to adjust the "trim" of the watercraft). A reverse gate actuating bracket preferably is connected to the trim ring and is linked to the reverse gate by means of a linkage, which linkage effects simultaneous vertical pivoting of the reverse gate actuating bracket and the reverse gate. Preferably, the linkage includes a linkage member that is vertically pivotally connected to the reverse gate actuating bracket, a linkage member that is vertically pivotally connected to the reverse gate, and a connecting rod extending between and connecting the two linkage members, which connecting rod is, itself, laterally pivotally connected to both linkage members. More preferably, the linkage assembly is configured such that the points about which the reverse gate pivots laterally when extended and retracted are, respectively, generally aligned with the vertical axis about which the nozzle member pivots laterally when the nozzle member is in a neutral trim position.

The reverse gate preferably has a rib extending along the surface which faces the nozzle member, and the rib is preferably configured such that end portions of it extend further upstream into an oncoming jet of water being expelled from the nozzle member than a central portion of the rib does. Additionally, the reverse gate preferably is laterally asymmetric to compensate for vorticity in the jet of water being expelled from the nozzle member. In particular, the reverse gate preferably has differentially sized flow outlet vents on its two sides and/or the flow outlet vents are configured such that the flow through one is directed more forwardly than the flow through the other.

The nozzle assembly preferably includes a tension spring, and the location of the tension spring mounting points preferably is such that, when the nozzle assembly is installed on the watercraft, the tension spring holds the reverse gate in the retracted position when it is in the retracted position and such that the tension spring holds the reverse gate in the extended position when it is moved into the extended position.

In another aspect, the invention features a waterjet-propelled watercraft having a hull with a rear portion and a nozzle assembly attached to the rear portion of the hull, which nozzle assembly is constructed in accordance with the first aspect of the invention and preferably incorporates one or more features of the preferred embodiments thereof.

Although the actuating linkage assembly provides perhaps its greatest advantage in the context of a nozzle assembly in which 1) the reverse gate is connected directly to the nozzle member and pivots vertically with respect to the nozzle member and 2) in which the nozzle member is vertically pivotally mounted so as to be able to adjust the "trim" of the watercraft (a configuration which can cause the horizontally oriented axis about which the reverse gate pivots to shift vertically as the nozzle member pivots vertically to adjust the trim position), the actuating linkage assembly has great utility in and of itself due to the enhanced freedom of pivoting motion of the various components—even in a nozzle assembly in which the nozzle member does not pivot vertically. For example, the configuration of the actuation linkage assembly provides a certain amount of "play" or flexibility into the system. Therefore, the same actuating linkage assembly components could be used in otherwise differently configured nozzle assemblies, e.g., nozzle assemblies in which the relative angular positions of the reverse gate and reverse gate actuating bracket differ.

Thus, according to a third aspect, the invention features a nozzle assembly that is capable of reversing the traveling direction of a waterjet-propelled watercraft. The nozzle assembly includes a nozzle member that is configured to be connected to a rear portion of the watercraft, and the nozzle member is laterally pivotable with respect to the watercraft for steering control (but is not necessarily vertically pivotable). The nozzle assembly further includes a retractible reverse gate linked to the nozzle member so as to pivot laterally with the nozzle member and a vertically pivotable reverse gate actuating bracket that is linked to the reverse gate by means of a reverse gate actuating linkage that is configured to effect simultaneous vertical pivoting of the reverse gate actuating bracket and the reverse gate. The reverse gate actuating linkage includes an actuating bracket linkage member that is vertically pivotally connected to the reverse gate actuating bracket; a reverse gate linkage member that is vertically pivotally connected to the reverse gate; and a connecting rod extending between and connecting the actuating bracket linkage member and the reverse gate linkage member, with the connecting rod being laterally pivotally connected to both of the linkage members.

In preferred embodiments according to this aspect of the invention, the reverse gate actuating linkage is configured such that when the reverse gate is retracted, the point about which it pivots laterally is generally aligned with the vertically oriented axis about which the nozzle member pivots laterally when the nozzle member is in a neutral trim position, and when the reverse gate is extended, the point about which the reverse gate pivots laterally is also generally aligned with the vertically oriented axis about which the nozzle member pivots laterally when in a neutral trim position. (In the context of this aspect of the invention, if the nozzle member is not vertically pivotable to "trim" the attitude of the watercraft, the set or given vertical angular position of the nozzle member is deemed to constitute the neutral trim position.)

In preferred embodiments, the reverse gate is pivotally attached directly to the nozzle member and pivots vertically with respect to it. The nozzle assembly may include a flow-accelerating venturi member to which the nozzle member is connected, or the nozzle assembly may be a retrofit assembly which is configured to be attached to a pre-existing flow-accelerating venturi member that is connected to the rear portion of a watercraft. Furthermore, in preferred embodiments, the nozzle member is gimbaled such that the nozzle member pivots laterally and does, in fact, pivot vertically.

The reverse gate preferably has a rib extending vertically along its inner surface which faces the nozzle member, which rib is configured such that end portions of it extend further upstream into an oncoming jet of water being expelled from the nozzle member than a central portion of the rib does. Furthermore, the reverse gate preferably has flow outlet vents formed in its sidewalls, with the flow outlet vents being differentially sized such that more water flows through one than through the other and/or with the flow outlet vents being configured such that water passing through one is directed more forwardly than water passing through the other.

A tension spring preferably is provided, with the attachment points being configured such that when the reverse gate is in its retracted position, the tension spring holds it in the retracted position, and when the reverse gate is in its extended position, the tension spring holds it in the extended position.

In another aspect, the invention features a waterjet-propelled watercraft incorporating a nozzle assembly constructed according to the third aspect of the invention and preferably incorporating one or more features of the preferred embodiments thereof.

In a fifth, broader or more fundamental aspect, the invention features a pivotal apparatus assembly. The apparatus includes a first pivoting member that is pivotal about a first pivot axis and a second pivoting member that is pivotal about a second pivot axis that is spaced from the first pivot axis. The second pivot axis (1) swings or pivots in a plane parallel to the first pivot axis through a range of angles with respect to the first pivot axis; and (2) moves in a direction normal to that parallel plane through a range of displacement distances relative to the first pivot axis. The apparatus further includes an actuating linkage assembly connecting the first and second pivoting members in a manner such that pivoting of the first pivoting member about the first pivot axis effects driven pivoting of the second pivoting member about the second pivot axis, and furthermore, the actuating linkage assembly is configured such that such driven pivoting results for any angular position of the second pivot axis within the range of angles through which the second pivot axis swings or pivots and for any displacement distance of the second pivot axis relative to the first pivot axis and within the range of displacement distances.

In preferred embodiments (e.g., in which the pivotal apparatus forms a water jet-propelled watercraft nozzle assembly), the linkage assembly includes a first linkage member that is pivotally attached to the first pivoting member and which pivots about a first linkage member pivot axis that is spaced from and extends parallel to the first pivot axis; a second linkage member that is pivotally attached to the second pivoting member and which pivots about a second linkage member pivot axis that is spaced from and extends parallel to the second pivot axis; and a connecting member that extends between and connects the first and second linkage members, with the connecting member being pivotally connected to the first linkage member at a first pivot point and pivotally connected to the second linkage member at a second pivot point. Furthermore, the first and second pivot points preferably are spaced from the first linkage member pivot axis and the second linkage member pivot axis, respectively.

According to a sixth broad or fundamental aspect of the invention, it is not necessary for the second pivot axis to move in a direction normal to the plane in which it swings or pivots. Thus, according to this aspect of the invention, the invention features pivotal apparatus including a first pivoting member that is pivotal about a first pivot axis and a second pivoting member that is pivotal about a second pivot axis that is spaced from the first pivot axis. The second pivot axis pivots in a plane parallel to the first pivot axis through a range of angles with respect to the first pivot axis. The apparatus further includes an actuating linkage assembly that connects the first and second pivoting members such that pivoting of the first pivoting member about the first pivot axis effects driven pivoting of the second pivoting member about the second pivot axis, and the actuating linkage assembly is configured such that the driven pivoting results for any angular position of the second pivot axis within the range of angles. In particular, the actuating linkage assembly includes a first linkage member that is pivotally attached to the first pivoting member and pivots about a first linkage member pivot axis that is spaced from and extends parallel to the first pivot axis; a second linkage member that is pivotally attached to the second pivoting member and which pivots about a second linkage member pivot axis that is spaced from and extends parallel to the second pivot axis; and a connecting member that extends between and connects the first and second linkage members, with the connecting member being pivotally connected to the first and second linkage members at respective first and second pivot points.

In preferred embodiments (e.g., in which the pivotal apparatus constitutes a nozzle assembly for use in a waterjet-propelled watercraft), the first pivot point is spaced from the first linkage member pivot axis and the second pivot point is spaced from the second linkage member pivot axis.

According to a seventh aspect of the invention, the invention features a reverse gate for reversing the traveling direction of a waterjet-propelled watercraft. The reverse gate, which includes a pair of sidewalls for connecting the reverse gate to the rear portion of the watercraft and a rear wall extending between the pair of sidewalls, is laterally asymmetric so as to compensate for vorticity in the waterjet.

In preferred embodiments, the reverse gate has a vertically extending median rib which faces into the oncoming waterjet, which rib is configured such that the end portions of it extend further upstream into the oncoming jet of water than a central portion of the rib does. Furthermore, the reverse gate preferably has flow outlet vents formed in the sidewalls, and the flow outlet vents are differentially sized and/or differentially configured so as to direct more water through one flow outlet vent than through the other flow outlet vent and/or so as to direct water flowing through one flow outlet vent more forwardly than water flowing through the other flow outlet vent.

In another aspect, the invention features a waterjet-propelled watercraft incorporating a reverse gate that is laterally asymmetric so as to compensate for vorticity in the waterjet.

In a further aspect, the invention features a method of operating a waterjet-propelled watercraft in a body of water. The method includes selecting a trim angle of the waterjet from a range of possible trim angles to control the attitude of the watercraft in the body of water; redirecting the waterjet so as to produce a propulsive force acting to propel the watercraft in a reverse direction; and laterally pivoting the waterjet to steer the watercraft and simultaneously controlling the redirecting of the waterjet such that as the waterjet pivots laterally, the direction in which the waterjet is redirected, copivots laterally therewith.

BRIEF DESCRIPTION OF THE DRAWINGS

These and other features of the invention will become clearer in connection with the drawings, in which.

DETAILED DESCRIPTION OF PREFERRED EMBODIMENTS

Figure 1:
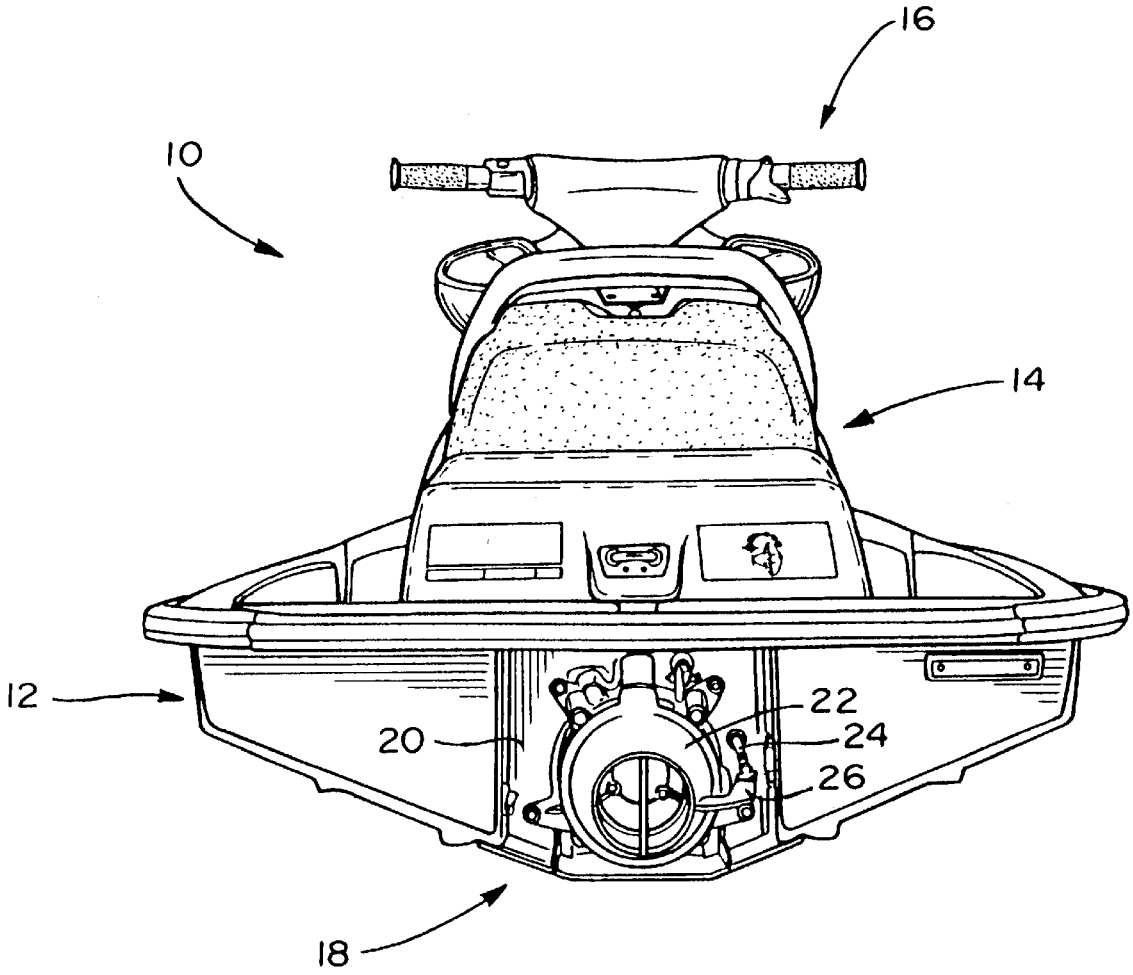
FIG. 1 (PRIOR ART)
FIG. 1 is a generalized rear view of a personal watercraft as known in the prior art.
Figure 2A:
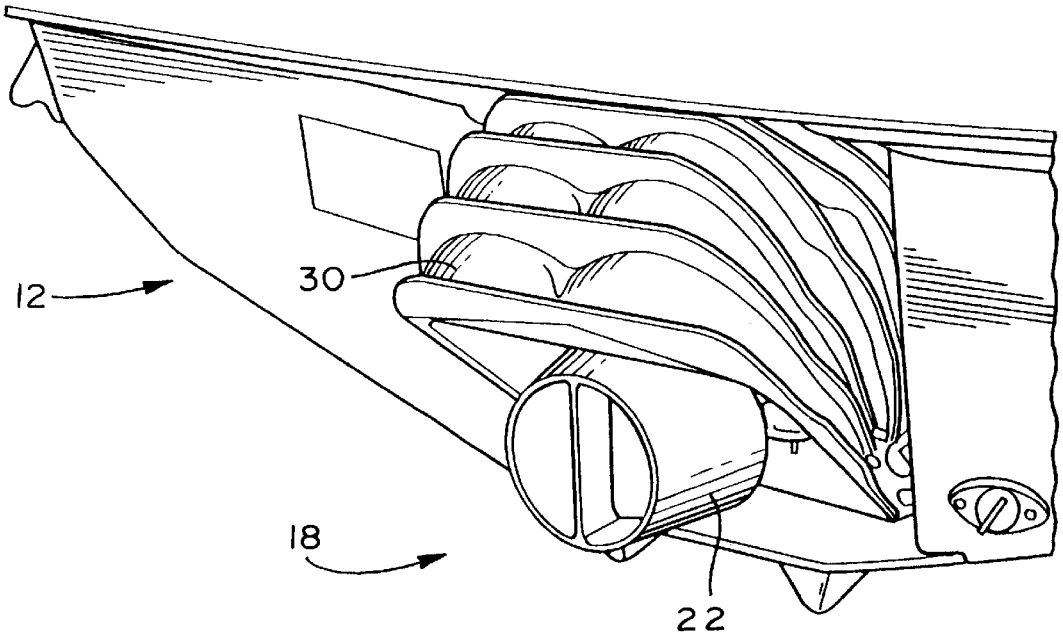
FIG. 2A (PRIOR ART)
FIGS. 2A and 2B are perspective views (from right and left sides, respectively) of the rear end of a personal watercraft as known in the prior art, showing the reverse gate in a stowed or retracted position and in an extended, thrust-reversing position, respectively.
Figure 2B:
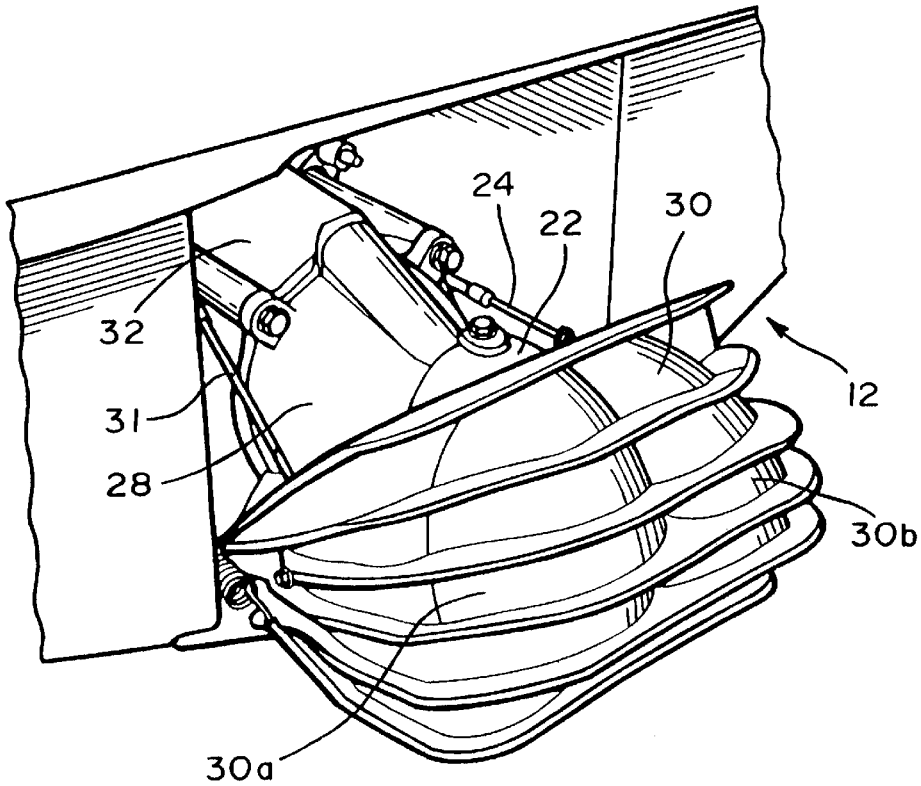
FIG. 2B (PRIOR ART)

One embodiment of an improved thrust-reversing nozzle assembly 118 according to the invention is illustrated in FIGS. 3–17. (To the extent components used in the nozzle assembly illustrated in FIGS. 3–17 are the same as or similar to components used in the prior art described above, they will be numbered with similar reference numerals in the 100 "series.") As illustrated in the various figures, steering-control nozzle member 122 (preferably made from die-cast aluminum) fits over the exit end 129 of flow-accelerating venturi member 128 (also preferably made from die-cast aluminum) with sufficient clearance to be able to pivot laterally through a range on the order of 40° (i.e., 20° left of centerline and 20° right of centerline), to steer the watercraft, as well as to pivot vertically through a range on the order of 18° (i.e., 9° above centerline and 9° below centerline), to "trim" the attitude of the watercraft in the water.

To that end, the nozzle member 122 is supported by pin support assemblies 134 and 136 located at upper and lower portions of the nozzle member 122 and trim ring 138, with the nozzle member 122 being supported inside of the trim ring 138 or, in other words, with the trim ring 138 surrounding the inlet end 123 of the nozzle member 122. Pivoting of the nozzle member 122 about its vertical pivot axis (i.e., about upper and lower pin support assemblies 134 and 136, where the nozzle member is supported by the trim ring 138) is controlled by push-pull steering linkage 286 (FIGS. 10–13), which steering linkage is pivotally connected (e.g., by a pin connection) to steering armature 126 extending from the nozzle member 122. Cut-outs 124 are formed in the inlet end 123 of the nozzle member 122 and prevent interference between the rear edge of the nozzle member 122 and pivot point pylons 168 on either side of the venturi member 128 as the nozzle member pivots full left and full right.

The trim ring 138, in turn, is pivotally supported for vertical pivoting by pin support assemblies 140 and 142 located at the left and right sides of the trim ring 138 and the flow-accelerating venturi member 128. The vertical pivot or "trim" position of the nozzle member 122 is controlled by pivoting the trim ring 138 about its horizontal pivot axis, i.e., about pin support assemblies 140 and 142. That pivoting movement of the trim ring 138 is controlled by a push-pull trim linkage rod (not shown), which is pivotally connected (e.g., pin-connected) to the trim ring by means of trim ring lug 139. (Details as to the construction and arrangement of the various pin support assemblies are described below.) This "gimballed" configuration permits the nozzle member 122 to pivot laterally (i.e., left and right), to steer the watercraft, and to pivot vertically (i.e., up and down), to "trim" the attitude of the watercraft in the water.

Additionally, reverse gate actuating bracket 144 (preferably made from die-cast aluminum) fits over the trim ring 138, with each arm 146, 148 of the reverse gate actuating bracket being pivotally supported by the pin support assemblies 140 and 142, respectively. The reverse gate actuating bracket can pivot fore and aft in a vertical plane, and can so pivot vertically independently of the trim ring 138 pivoting in the same vertical plane. Recess or hollow 147 formed by the dogleg configuration of the right arm 148 of the reverse gate actuating bracket (shown most clearly in FIG. 3) prevents interference between the steering armature 126 and the right arm 148 of the reverse gate actuating bracket when the nozzle member is pivoted to the right, particularly when the reverse gate is extended (reverse gate actuating bracket is pivoted aft) and the nozzle member is pivoted vertically into the "nose up" trim position.

Figure 4:
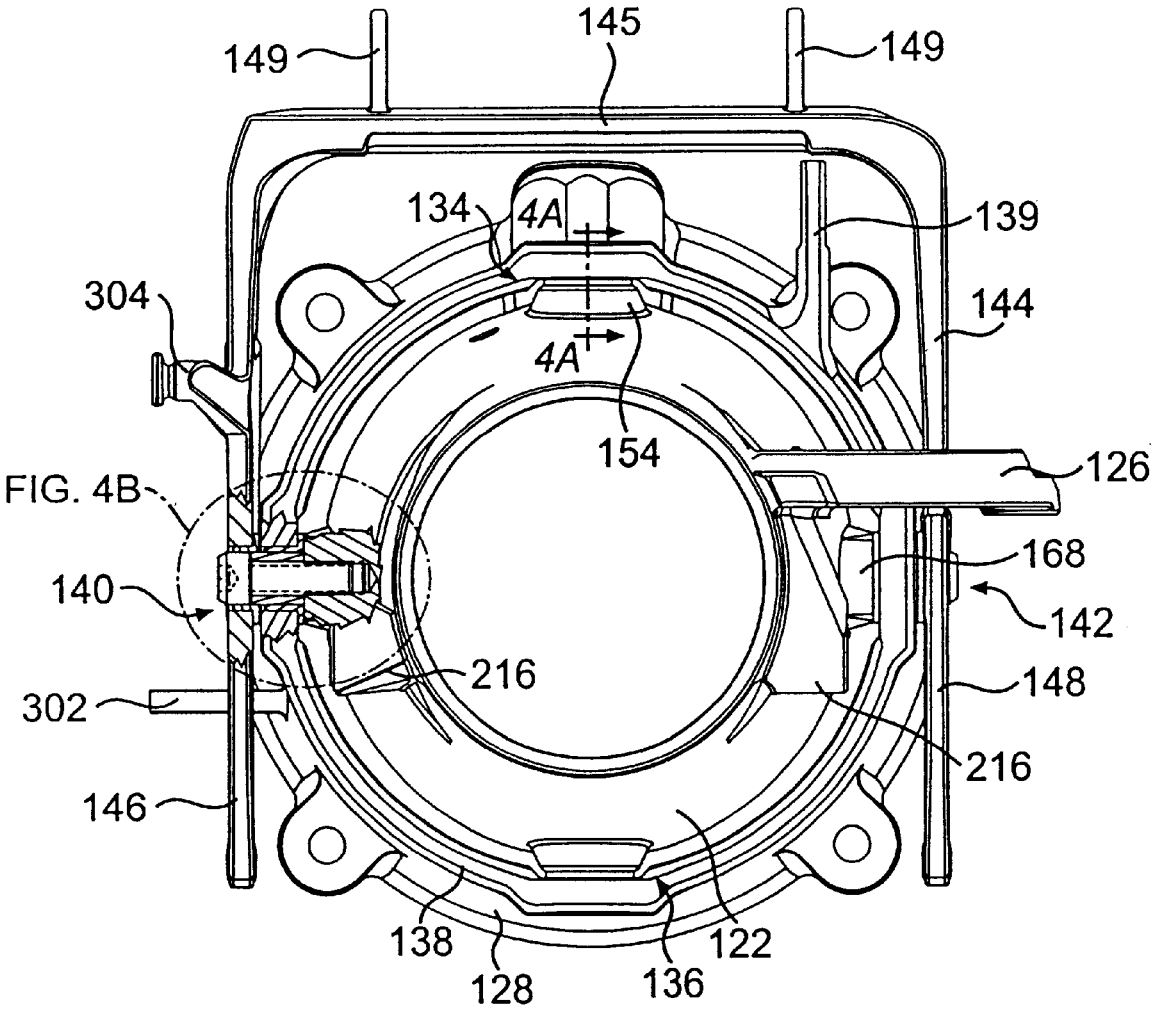
FIG. 4 is an end view of the nozzle assembly shown in FIG. 3, without the reverse gate being shown for clarity.
Figure 4A:
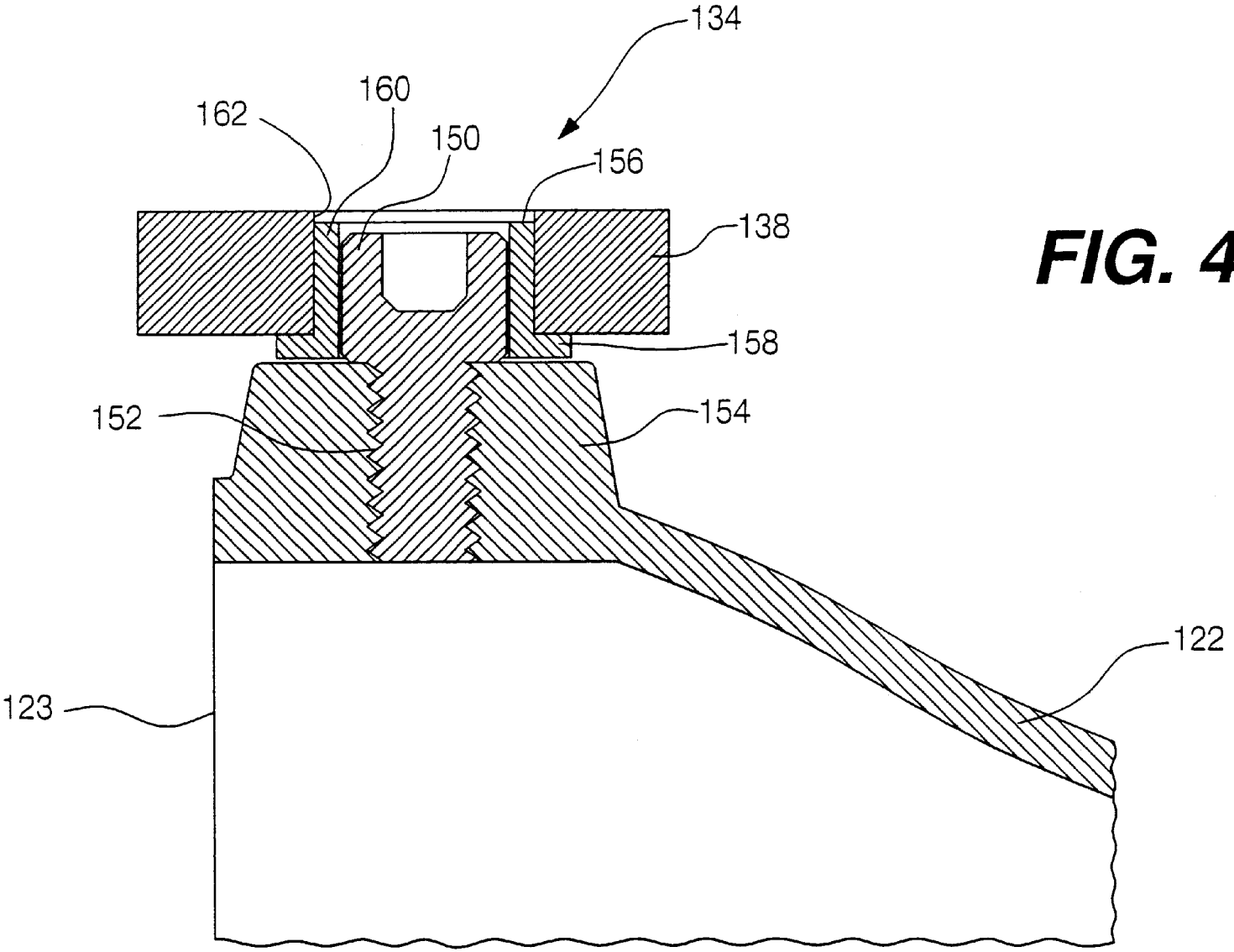
FIG. 4A is a section view taken along lines 4A—4A in FIG. 4

As shown in FIG. 4A, the upper pin support assembly 134, which together with the similarly constructed lower pin support assembly 136 supports the nozzle member 122 within the trim ring 138, includes a stainless steel, hex-socket bolt 150 which is fastened tightly into threaded bore 152. Threaded bore 152 extends vertically through an enlarged, generally circular (in plan view) "land" portion 154 formed at the upper portion of the inlet end 123 of the nozzle member 122. Flanged bushing 156 has 1) a circular, disc-shaped flange portion 158 disposed between the lower surface of the upper portion of the trim ring 138 and the land portion 154 of the nozzle member; and 2) a cylindrical portion 160 surrounding the head of the bolt 150 and disposed between the outer surface of the head of the bolt and the inner surface of bore 162, which bore 162 extends vertically through the upper portion of the trim ring 138. The flanged bushing 156 facilitates rotation of the nozzle member 122 relative to the trim ring 138 by virtue of the upper surfaces of the land portion 154 rotationally sliding relative to the flange portion 158 of the flanged bushing and by virtue of the head of the bolt 150 rotationally sliding relative to the cylindrical portion 160. The flanged bushing 156 preferably is made from hard plastic such as IGLIDE brand thermoplastic (e.g., selected from the IGLIDE G300 family), nylon, or other similar, low-friction material.

Figure 3:
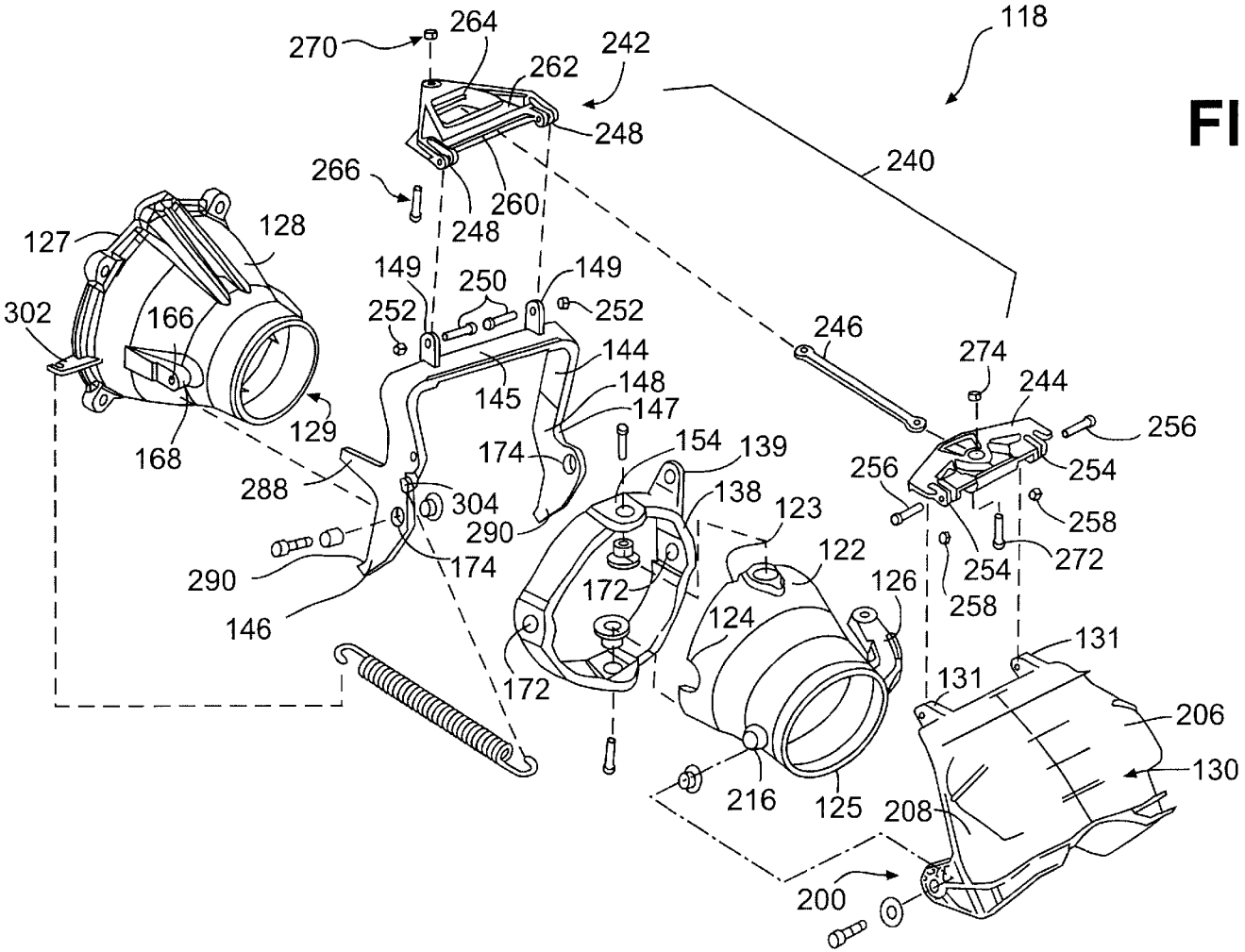
FIG. 3 is an assembly view illustrating the construction and arrangement of a thrust-reversing nozzle assembly according to the invention.
Figure 4B:
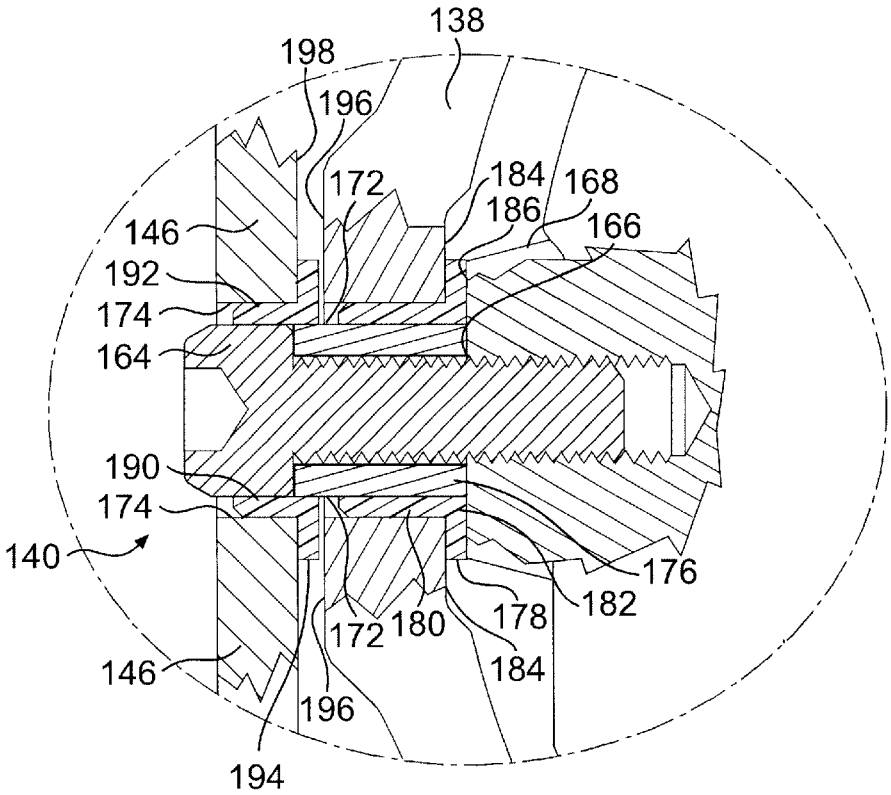
FIG. 4B is an enlarged break-away view, partially in section, of the encircled portion of FIG. 4.

Similarly, as shown in FIG. 4B, the left pin support assembly 140 (and, likewise, the right pin support assembly 142) includes a stainless steel, hex-socket threaded bolt 164 which is fastened tightly into threaded bore 166. Threaded bore 166 extends laterally or horizontally into forward pivot point pylon 168 protruding from the exterior, side region of the venturi member 128 (shown most clearly in FIGS. 3 and 4), generally half way between the inlet end 127 of the venturi member 128 and the outlet end 129 of the venturi member. The bolt 164 extends through a smooth, cylindrical-walled bore 172 extending through the trim ring 138 (one on either side, as shown in FIG. 3) and a smooth, cylindrical-walled bore 174 extending through arm 146 of reverse gate actuating bracket 144.

A cylindrical, stainless steel bushing 176 surrounds the bolt 164 around the upper portion of the shank of the bolt, i.e., around the portion closest to the head of the bolt. A flanged bushing 178, which is similar to flanged bushing 156 in terms of overall geometry and material from which it is made, is press-fit into the bore 172. The cylindrical portion 180 of the flanged bushing 178 is located between the stainless steel cylindrical bushing 176 and the surface of the bore 172 and surrounds the bushing 176 with a clearance fit, and the circular, disc-shaped flange portion 182 is located between the inner-facing surface 184 of the trim ring 138 and the outer-facing surface 186 of the pivot point pylon 168. The bushings 176 and 178 permit the trim ring 138 to pivot vertically with respect to the venturi member 128 as 1) the flange portion 182 of the flanged bushing slides rotationally relative to the outer-facing surface 186 of the pivot point pylon 168; and 2) as the cylindrical portion 180 of the flanged bushing slides rotationally relative to the stainless steel cylindrical bushing 176 and/or as the stainless steel cylindrical bushing 176 slides rotationally relative to the shank of the bolt 164.

A second flanged bushing 190, which is similar to both the flanged bushings 156 and 178 in terms of overall geometry and the material from which it is made, is also provided as part of the pin support assembly 140. The cylindrical portion 192 of the flanged bushing 190 is press-fit into the bore 174 in the reverse gate actuating bracket arm 146, and the disc-shaped flange portion 194 is sandwiched between the outer-facing surface 196 of the trim ring 138 and the inner-facing surface 198 of the arm 146. The laterally outermost portion of the stainless steel bushing 176 and the head of the bolt 164 fit within the cylindrical portion of the flanged bushing 190 with a clearance fit. With this configuration, the reverse gate actuating bracket 144 is able to pivot fore and aft relative to the venturi member 128— and can do so independently of any pivoting motion of the trim ring 138— as 1) the flanged portion 194 of the flanged bushing slides relative to the outer-facing surface 196 of the trim ring; and 2) as the inner surface of the cylindrical portion 192 of the flanged bushing slides relative to the head of the bolt 164 and relative to the outermost portion of the stainless steel cylindrical bushing 176.

Figure 5A:
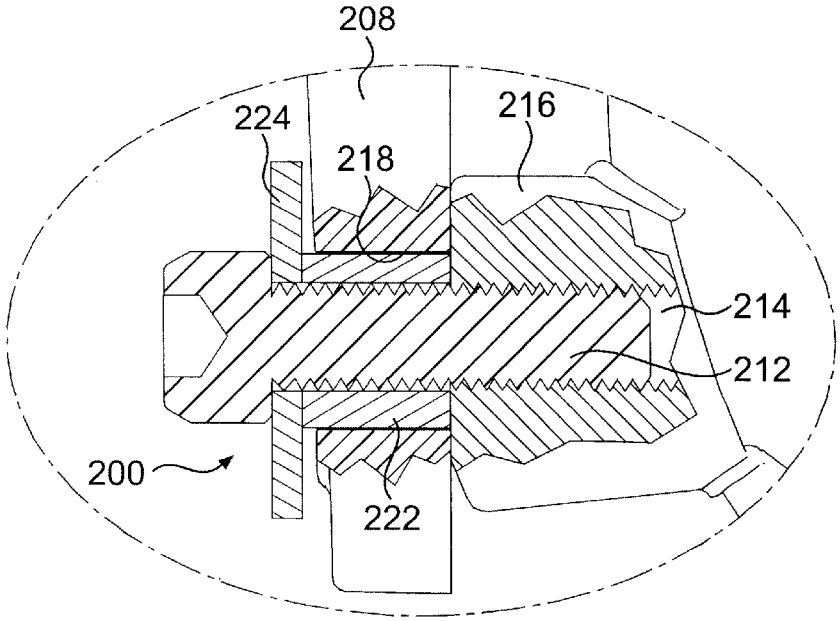
FIG. 5A is an enlarged break-away view, partially in section, of the encircled portion of FIG. 5.
Figure 5:
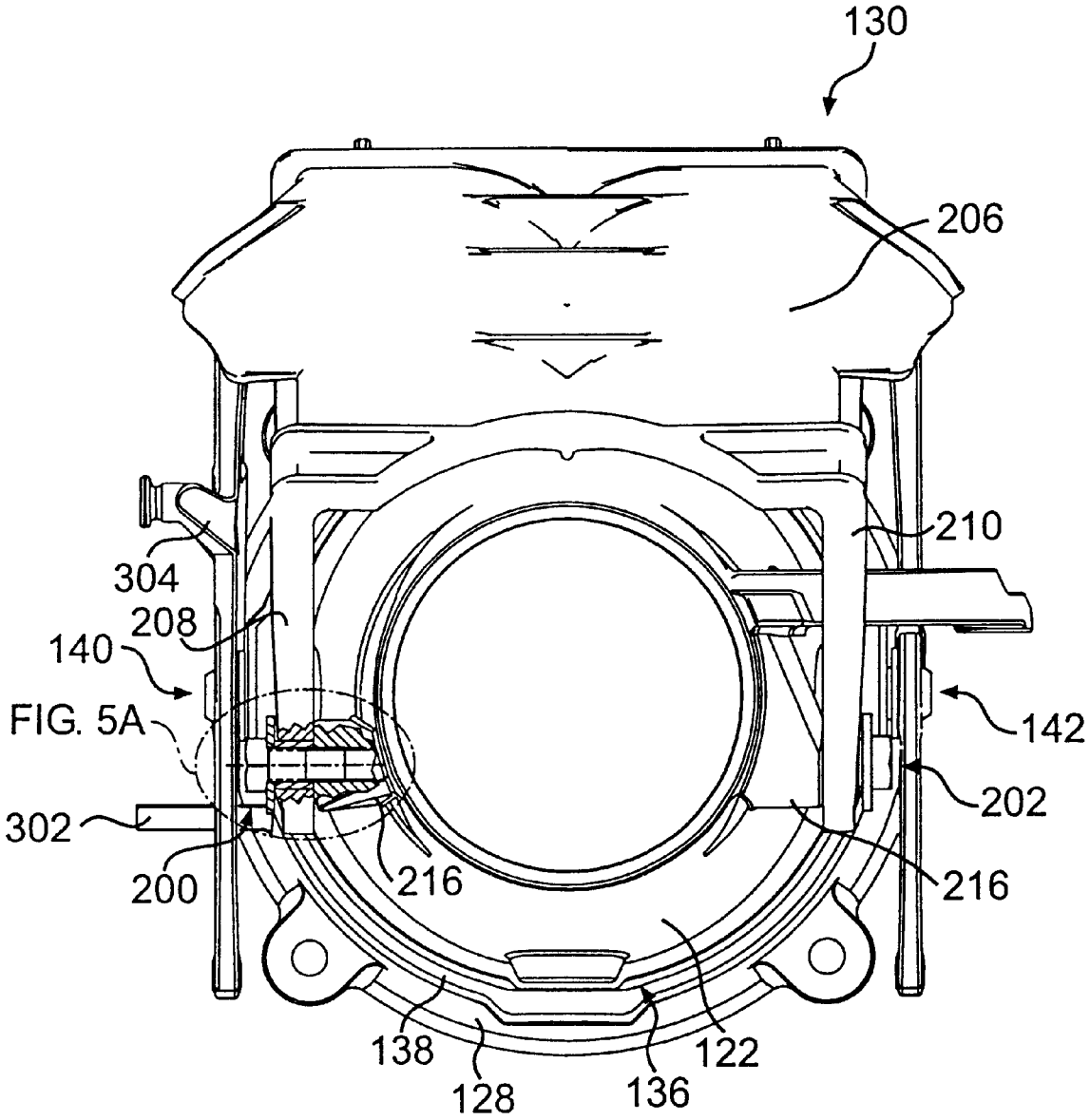
FIG. 5 is an end view of the nozzle assembly shown in FIG. 3, similar to FIG. 4 but with the reverse gate present.

As shown in FIG. 3 and, in greater detail, in FIGS. 6–9, 15, and 16 (described in greater detail below), the retractable reverse gate 130 has a waterjet-redirecting rear wall 206 and a pair of mounting arms 208 and 210 extending forward from the lateral sides of the rear wall 206. As illustrated in FIGS. 5, 10–13, 16, and 17, the reverse gate 130 is vertically pivotally attached to the nozzle member 122 by means of the mounting arms 208 and 210 at pin support assemblies 200 and 202 on the left and right sides of the nozzle member 122, respectively. As shown in greater detail in FIG. 5A, pin support assembly 200 (and similarly pin support assembly 202) includes a stainless steel, hex-head bolt 212 which is threaded tightly into threaded bore 214 extending laterally or horizontally through rear pivot point pylon 216 (one pivot point pylon on either side of the nozzle member 122), which pivot point pylon protrudes from the side of the nozzle member approximately half way between the nozzle inlet end 123 and the nozzle outlet end 125. The bolt 212 passes through a cylindrical, smooth-walled bore 218 extending through the connecting lobe portion 220 of mounting arm 208 (see FIG. 14).

A stainless steel, cylindrical bushing 222 fits within the bore 218 with a clearance fit and surrounds the upper portion of the shank of the bolt 212, i.e., the portion closest to the head of the bolt. A stainless steel washer 224 also surrounds the shank of the bolt, between the cylindrical bushing 222 and the head of the bolt. This assembly permits the reverse gate 130 to pivot vertically or fore and aft with respect to the nozzle member 122 as the surface of the bore 218 slides rotationally relative to the outer surface of the cylindrical bushing 222 and/or as the inner surface of the bushing 222 slides rotationally relative to the shank of the bolt 212. (Further details of the various geometries and design features of the reverse gate, and the considerations behind those geometries and design features, are addressed fully below.)

The reverse gate 130 and the reverse actuating bracket 144 are linked together for extension and retraction of the reverse gate by means of a sophisticated yet elegantly simple actuation linkage assembly 240. The actuation linkage assembly 240 includes a front, vertically pivotal actuation bracket flap 242; a rear, vertically pivotal reverse gate flap 244; and a reverse gate connector rod 246 extending between them.

The front, actuation bracket flap 242 (preferably made from molded BKV-30-RM, fiberglass-reinforced nylon) is pivotally connected to the upper, cross-brace portion 145 of the reverse gate actuating bracket 144 by means of actuating bracket lugs 149, which fit within slots 248 at either side of the actuation bracket flap 242 with a clearance fit. The actuation bracket flap is secured to the actuation bracket lugs 149 by means of stainless steel pins 250, which are held in place by means of stainless steel nuts 252 that are screwed onto the threaded ends of the pins 250. This mounting configuration permits the actuation bracket flap to pivot vertically with respect to the actuation bracket 144.

Similarly, the reverse gate 130 has four reverse gate lugs 131 extending from its upper portion, with two near either side. The reverse gate flap 244 (preferably made from molded BKV-30-RM, fiberglass-reinforced nylon) has a pair of lugs 254, with one near either side, and the lugs 254 on the reverse gate flap 244 fit between the reverse gate lugs 131. The reverse gate flap 244 is pivotally connected to the reverse gate by means of stainless steel pins 256; the pins 256 pass through aligned holes in the lugs 131 and 254 and are secured by means of stainless steel nuts 258 that are screwed onto the threaded ends of the pins 256. This mounting configuration allows the reverse gate flap 244 to pivot vertically with respect to the reverse gate 130.

Reverse gate connector rod 246 (preferably made from stainless steel) links the front, actuation bracket flap 242 and the rear, reverse gate flap 244 and drives the reverse gate 130 fore and aft, to extend and retract it, as the actuation bracket 144 pivots about its horizontal pivot axis, i.e., about pin support assemblies 134 and 136. The reverse gate connector rod 246 is pin-fixed to each of the flaps 242 and 244 and can pivot laterally with respect to each. The forward end of the reverse gate connector rod 246 passes through a horizontal, laterally extending slot 260 formed in actuation bracket flap cross-brace 262; through slot 264 at the forward, vertex portion of the actuation bracket flap 242; and is secured with a stainless steel pin 266. The pin 266 passes through aligned holes in the forward end of the reverse gate connector rod 246 and in flap tangs 268 (which are separated by the slot 264) and is secured by means of stainless steel nut 270, which is screwed onto the threaded end of the pin 266. Similarly, the rear end of the reverse gate connector rod 246 passes under a forward, extension portion 245 of the reverse gate flap 244 and is pin-fixed to the reverse gate flap 244 by means of stainless steel pin 272. The pin 272 passes through aligned holes in the reverse gate flap and the rear end of the reverse gate connector rod and is secured by means of stainless steel nut 274, which is screwed onto the threaded end of the pin 272.

It will be observed that the front connector rod pivot point 280 (i.e., the pivot axis formed by pin 266) is located ahead of the axis about which the actuation bracket flap 242 pivots vertically (i.e., the pivot axis formed by pins 250). Similarly, it will be observed that the rear connector rod pivot point 282 (i.e., the pivot axis formed by pin 272) is located slightly ahead of the axis about which the reverse gate flap 244 pivots vertically (i.e., the axis formed by pins 256). The significance of the location of each of the front and rear connector rod pivot points 280 and 282 will become clear with reference to FIGS. 6–13, as will the significance of the vertical pivotability of the actuation bracket flap 242 and reverse gate flap 244 and the lateral pivotability of the reverse gate connector rod 246.

Figure 6:
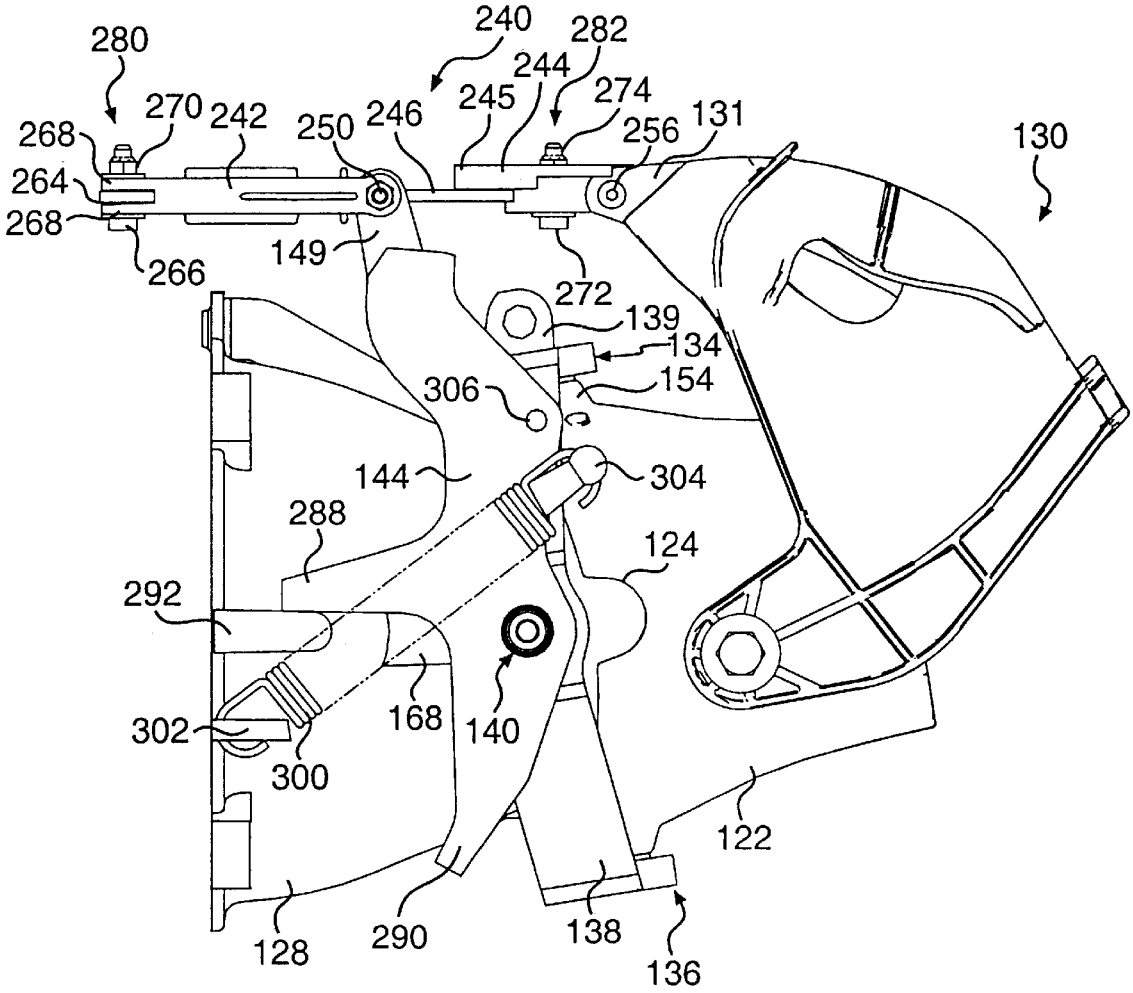
FIGS. 6–9 are side views of the nozzle assembly shown in FIG. 3, illustrating the four possible combinations of the nozzle member being pivoted to either the full "nose-up" trim position or the full "nose-down" trim position and the reverse gate being extended or retracted.
Figure 7:
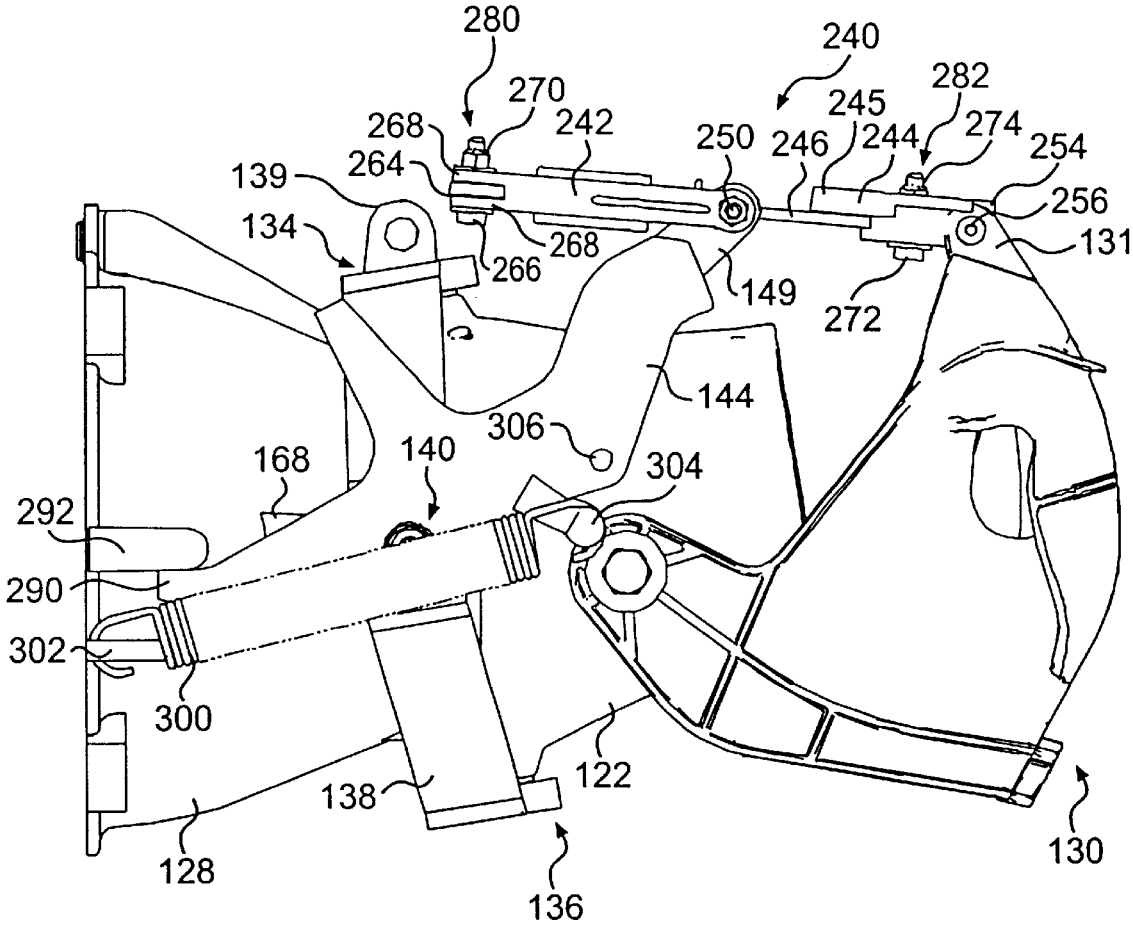
Figure 8:
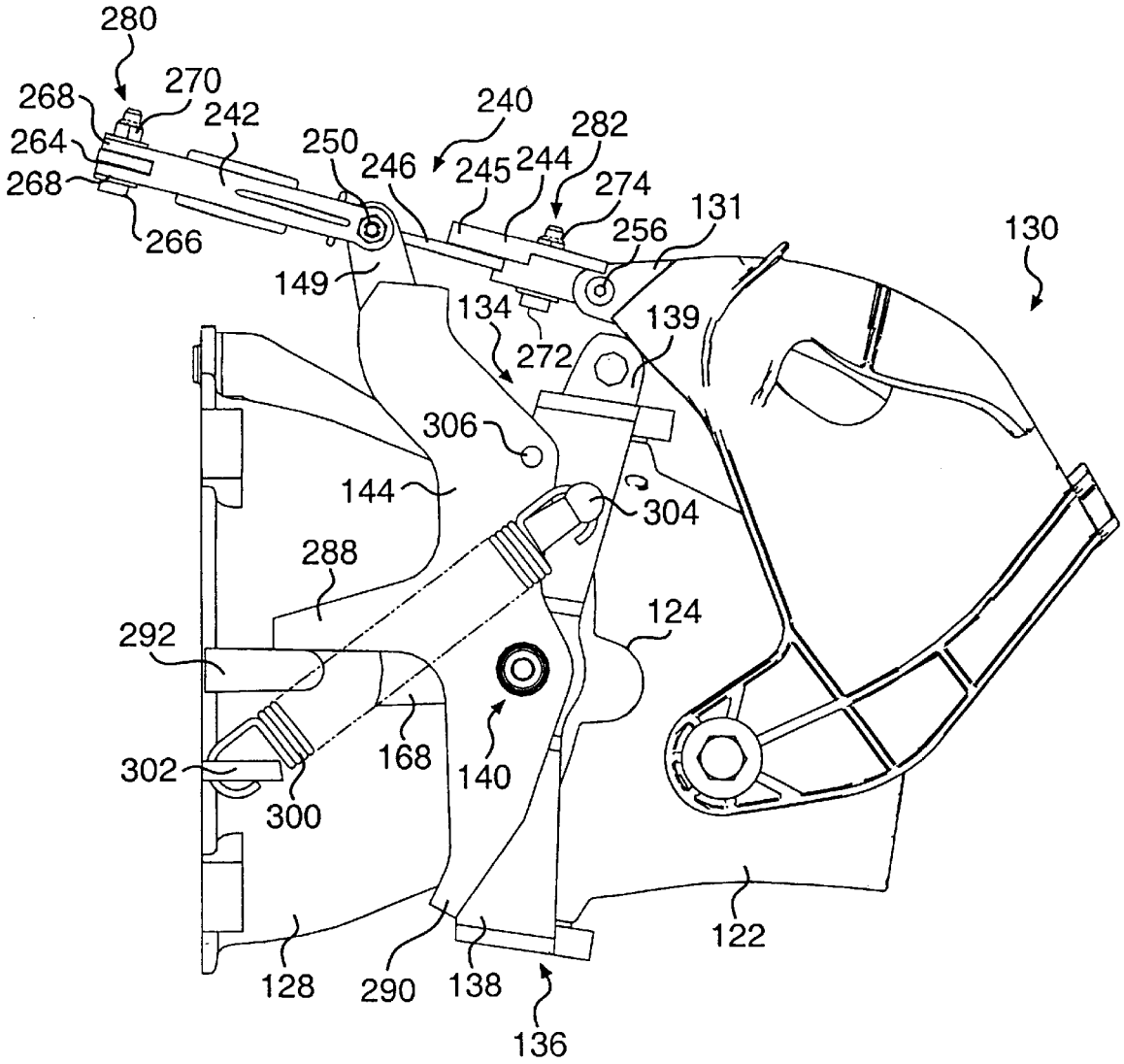
Figure 9:
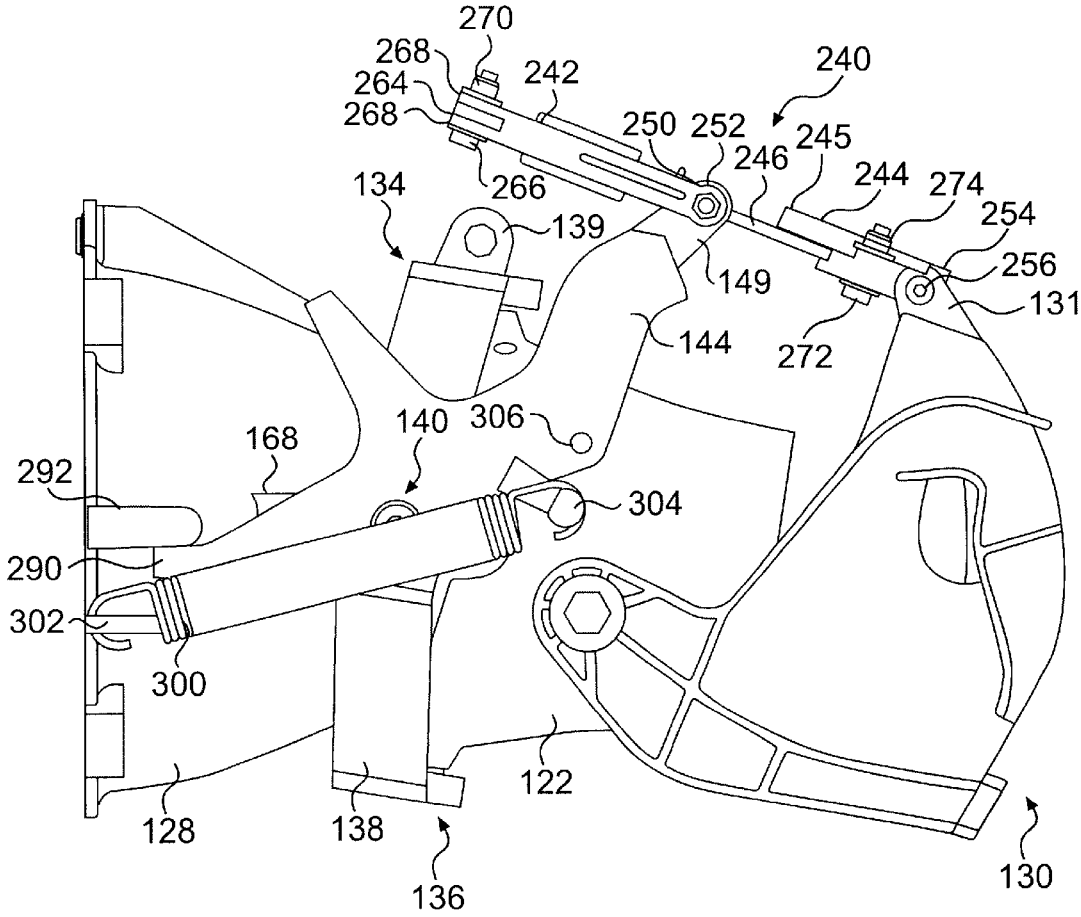

In particular, FIGS. 6 and 7 illustrate the nozzle assembly with the nozzle member 122 in a "nose up" trim position (to push the rear of the watercraft down into the water); FIG. 6 shows the assembly with the reverse gate 130 retracted for forward travel, and FIG. 7 shows the assembly with the reverse gate extended for reverse travel. As will be apparent from comparing FIGS. 6 and 7, as the reverse gate actuation bracket 144 pivots aft and the reverse gate 130 rotates into its extended, flow-reversing position (as shown in FIG. 7), the actuation bracket flap 242 and reverse gate flap 244 will pivot vertically about their respective pivot axes (counterclockwise as shown in FIGS. 6 and 7). (Actuation of the reverse gate actuating bracket 144 is described more fully below.) Similarly, the nozzle assembly is shown with the nozzle member 122 in a "nose down" trim position in FIGS. 8 and 9, with the reverse gate in its retracted and extended positions, respectively. It will be apparent from comparing FIGS. 8 and 9 that when the nozzle is in its "nose down" trim position, the actuation bracket flap 242 and the reverse gate flap 244 will still pivot about their respective pivot axes (counterclockwise as shown in FIGS. 8 and 9) as the actuation bracket and the reverse gate pivot from their retracted positions to their extended positions, just like the case when the nozzle is in the "nose up" trim position shown in FIGS. 6 and 7.

Figure 10:
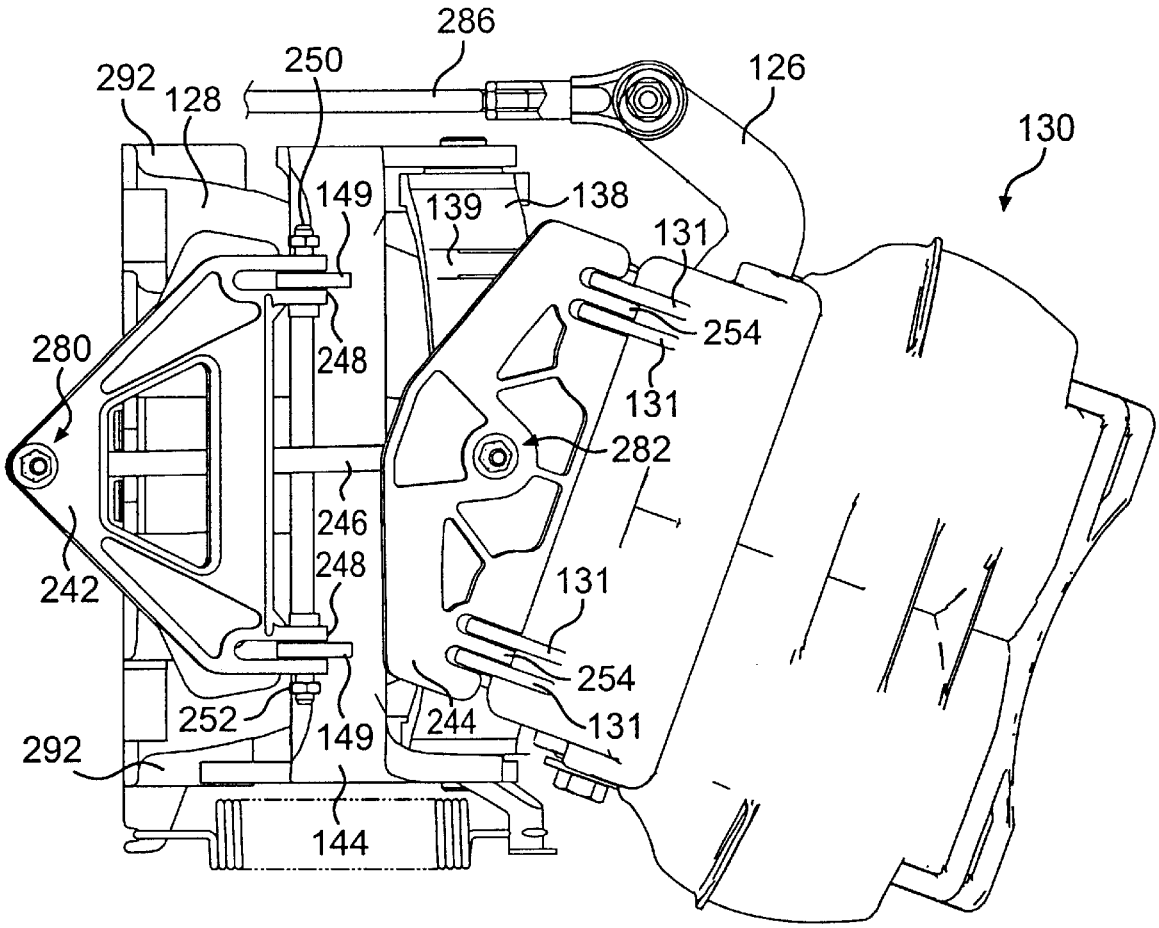
FIGS. 10–13 are plan views of the nozzle assembly shown in FIG. 3, illustrating the nozzle member (and, with it, the reverse gate) being pivoted laterally both left and right with the reverse gate being retracted in FIGS. 10 and 11 and extended in FIGS. 12 and 13, with the nozzle member being set at a neutral trim position.
Figure 11:
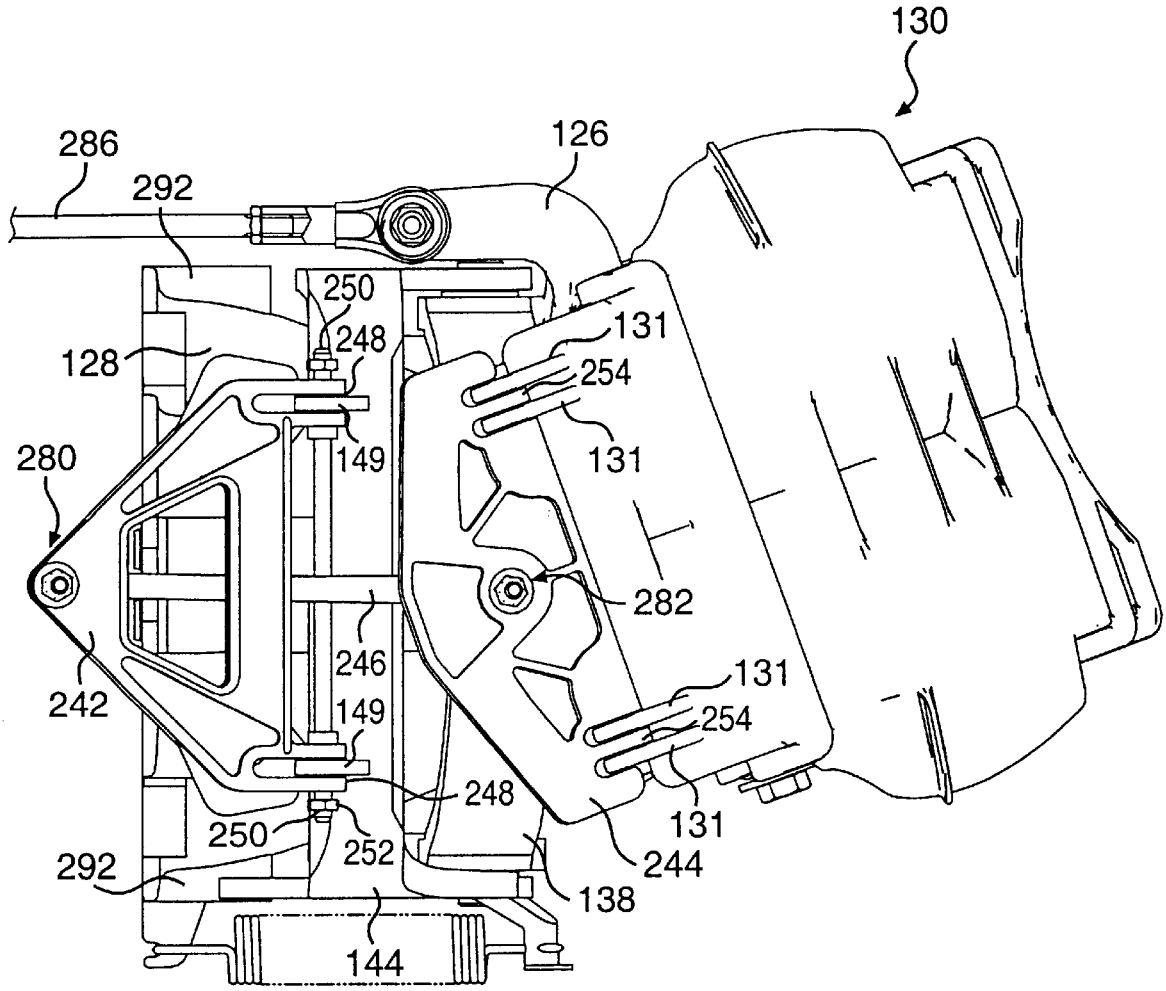
Figure 12:
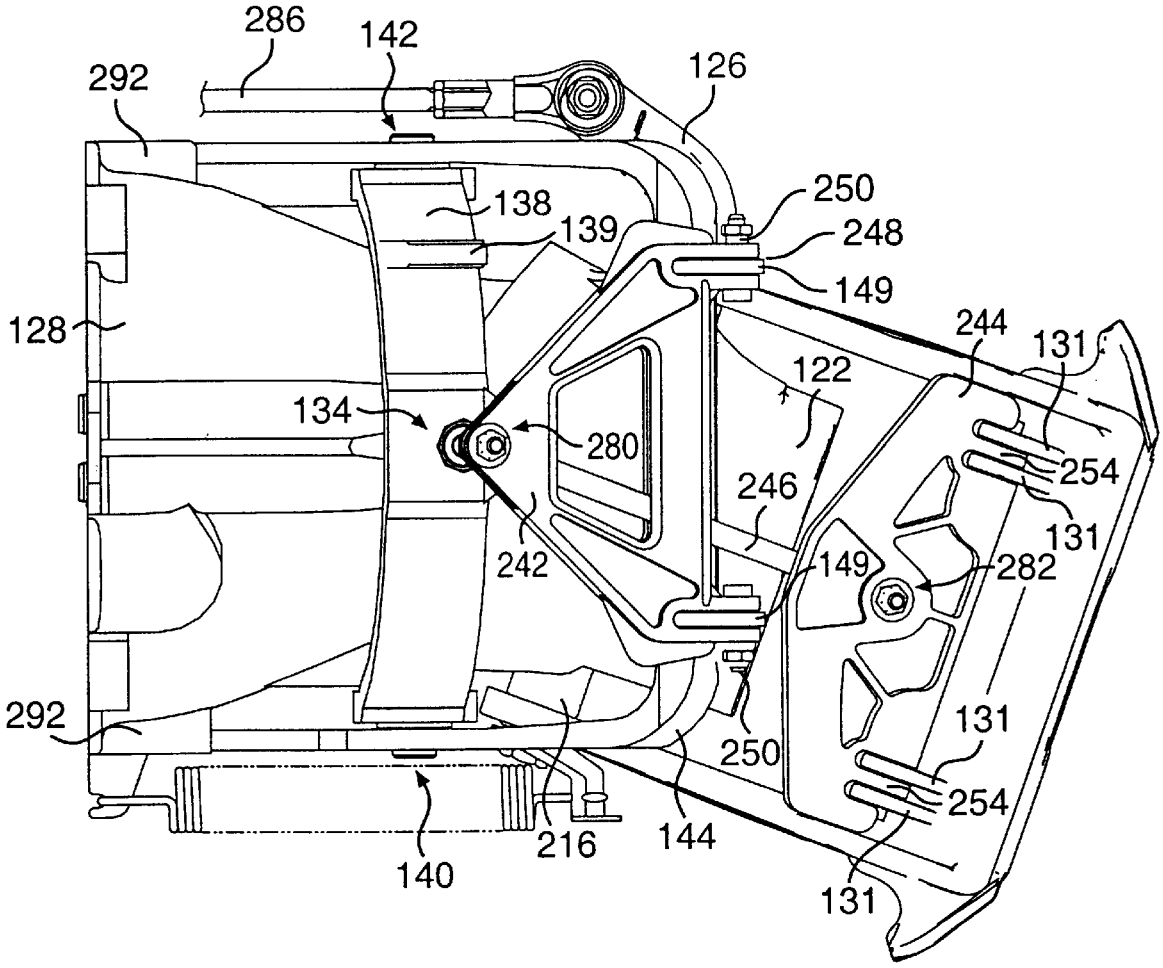
Figure 13:
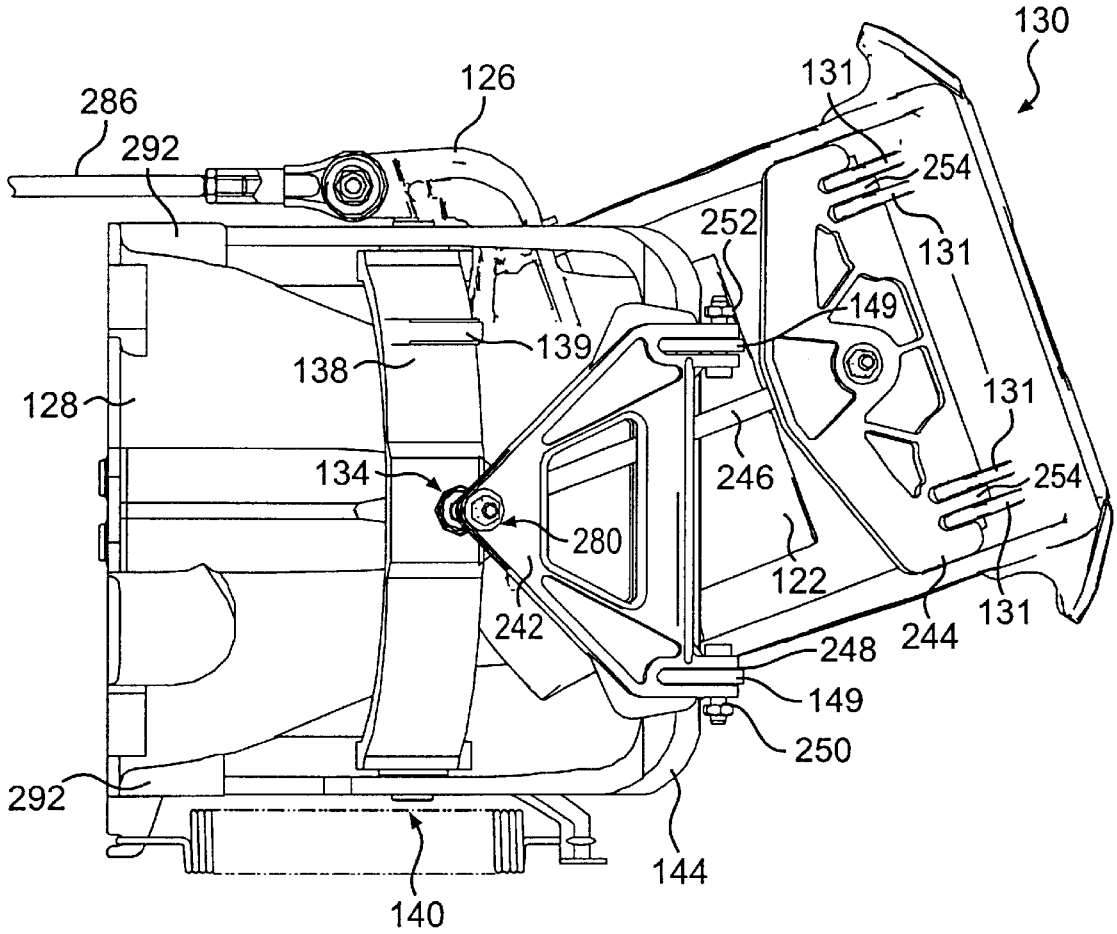
Figure 14:
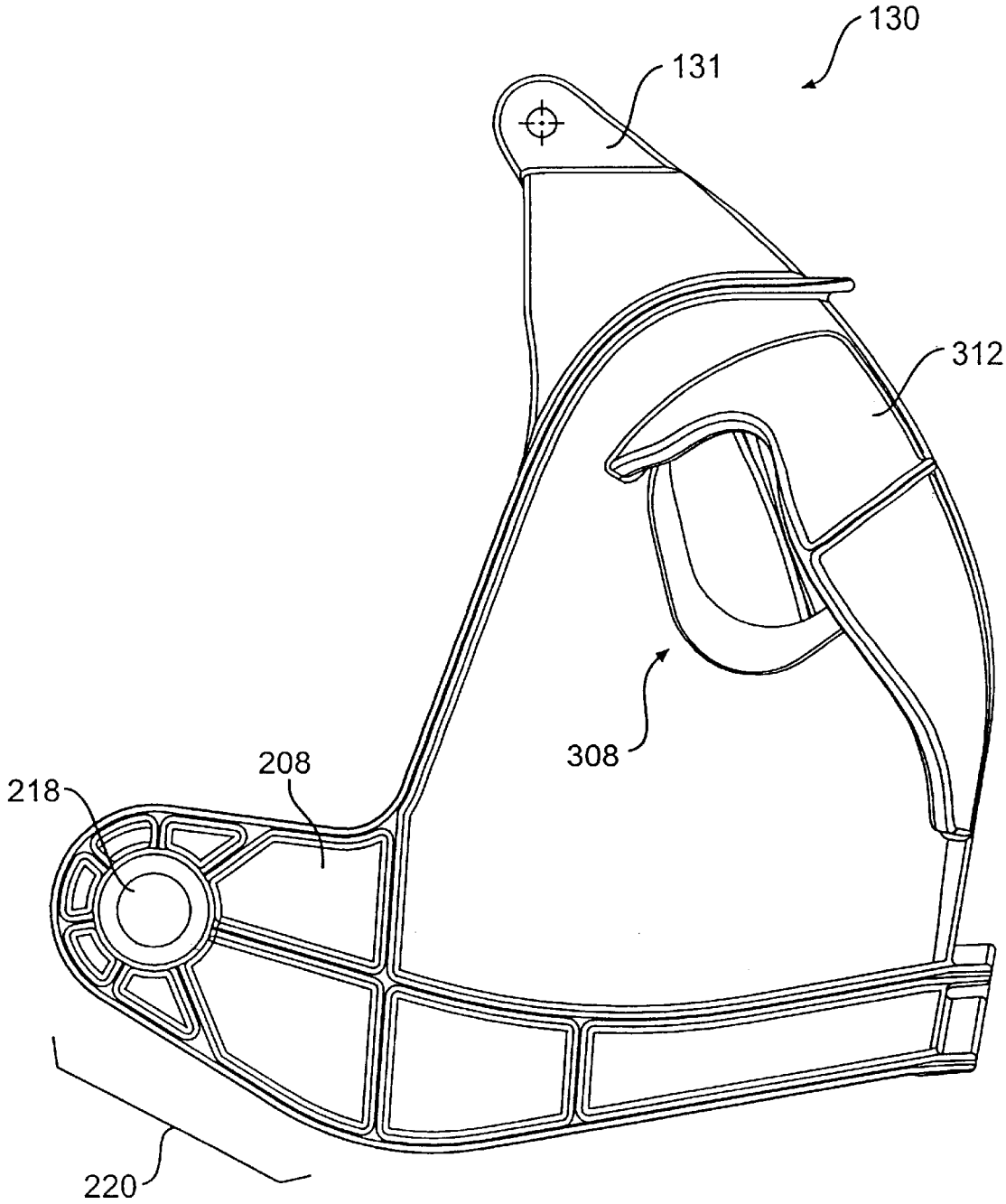
FIG. 14 is a side view of the reverse gate shown in FIG. 3.
Figure 15:
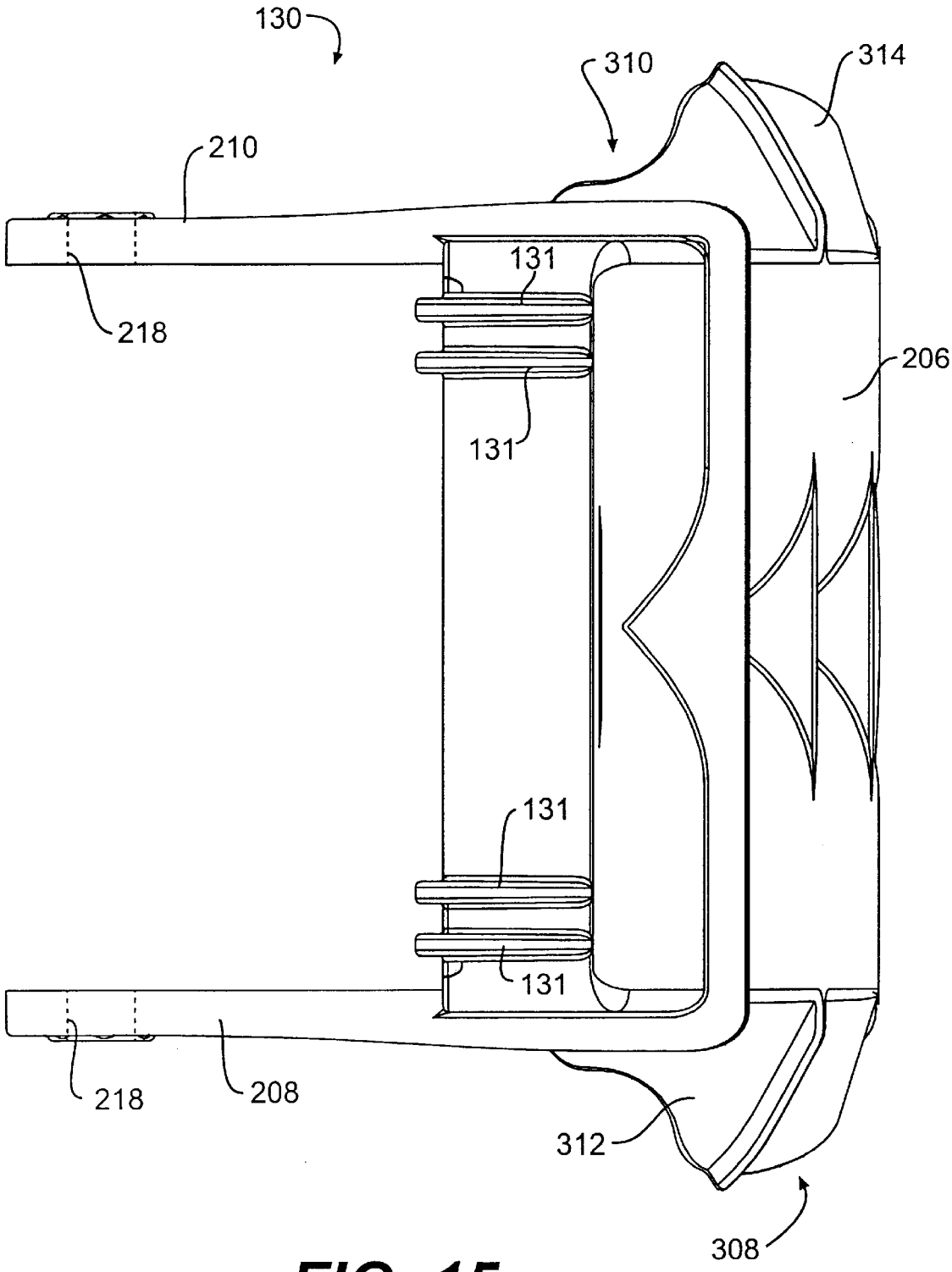
FIG. 15 is a plan view of the reverse gate shown in FIG. 3.

Furthermore, FIGS. 10–13 illustrate the dynamics of the linkage assembly as the nozzle member 122 (and hence the reverse gate 130) pivots laterally to steer the watercraft, with the reverse gate retracted for forward travel in FIGS. 10 and 11 and extended for reverse travel in FIGS. 12 and 13. In each of FIGS. 10–13, the resultant position of the various components is shown with the nozzle member 122 in a neutral trim position, i.e., half way between the "nose up" trim position (shown in FIGS. 6 and 7) and the "nose down" trim position (shown in FIGS. 8 and 9).

As illustrated in FIGS. 10 and 11, when the reverse gate is retracted, it pivots laterally about rear connecting rod pivot point 282 as the nozzle member 122 pivots left and right about its own vertical pivot axis, i.e., about pin support assemblies 134 and 136. Thus, the reverse gate connector rod 246 remains stationary, but the reverse gate flap 244 pivots relative to it about rear connector rod pivot point 282 as the reverse gate/reverse gate flap assembly pivots relative to the reverse gate connector rod 246. On the other hand, when the reverse gate is extended as illustrated in FIGS. 12 and 13, the reverse gate connector rod 246, which shifts rearward into position over the nozzle member 122, pivots with the reverse gate as the nozzle member pivots left and right. Thus, when the reverse gate is extended, the connecting rod 246 remains fixed relative to the reverse gate flap 244 but pivots relative to the actuation bracket flap 242, pivoting about front connector rod pivot point 280.

Because the nozzle member pivots laterally about a vertical axis extending between pin support assemblies 134 and 136, in order for the reverse gate to pivot with the nozzle member, the vertically oriented, lateral pivot axis of the reverse gate must be (and must remain) generally aligned with the vertically oriented, lateral pivot axis of the nozzle member. Accordingly, when the reverse gate is retracted, as shown in FIGS. 10 and 11, the rear connecting rod pivot point 282 about which the reverse gate pivots laterally is generally aligned with the lateral nozzle member pivot axis extending between pin support assemblies 134 and 136; and when the reverse gate is extended, as shown in FIGS. 12 and 13, the front connector rod pivot point 280 about which the reverse gate pivots shifts generally into alignment with the lateral nozzle member pivot axis.

As will be observed by comparing FIG. 6 (reverse gate retracted, with the nozzle member in the full "nose up" trim position) to FIG. 8 (reverse gate retracted, with the nozzle member in the full "nose down" trim position), the longitudinal or fore-and-aft position of the rear connecting rod pivot point 282 (about which the reverse gate pivots laterally when retracted) will vary slightly depending on the trim position of the nozzle member, from slightly behind the vertically oriented lateral pivot axis of the nozzle member to slightly in front of it. Therefore, the amount of "offset" of the rear connecting rod pivot point 282 from the horizontal axis about which the reverse gate flap 244 pivots vertically is selected such that, on average, the rear connecting rod pivot point 282 is generally aligned with the pin support assemblies 134 and 136 about which the nozzle member pivots laterally, i.e., so that it is approximately centered over the pin support assemblies 134 and 136 when the nozzle member is half way between the full "nose up" and full "nose down" trim positions.

Similarly, as will be observed by comparing FIG. 7 (reverse gate extended, with the nozzle member in the full "nose up" trim position) to FIG. 9 (reverse gate extended, with the nozzle member in the full "nose down" trim position), the longitudinal position of the front connecting rod pivot point 280 (about which the reverse gate pivots laterally when extended) will vary slightly depending on the trim position of the nozzle member 122, from slightly behind the vertically oriented, lateral pivot axis of the nozzle member to slightly in front of it. Therefore, the amount of "offset" between the front pivot point 280 and the horizontal axis about which the front, actuation bracket flap 242 pivots vertically is selected such that, on average, the front connecting rod pivot point 280 is similarly generally centered over or aligned with the vertically oriented, lateral pivot axis of the nozzle member 122, i.e., so it is approximately centered over the pin support assemblies 134 and 136 when the nozzle member is in the neutral trim position.

Finally, with respect to the dynamics of the relative pivotal motion of the various nozzle assembly components, it will be appreciated that any non-alignment between the front and rear connecting rod pivot points and the vertical axis about which the nozzle member pivots laterally when the reverse gate is extended or retracted will be "compensated for" by a certain amount of "play" in the pin fittings at the front and rear ends of the reverse gate connecting rod as well as by slight amounts of vertical pivoting of either or both of the flaps 242 and 244. Additionally, lateral pivoting of the nozzle member and the reverse gate when the nozzle member is at some intermediate trim position and/or if the reverse gate is at an intermediate extension position will cause some combination of slight vertical pivoting of either or both of the flaps 242 and 244 as well as varying amounts of pivotal motion of the front and rear flaps relative to the ends of the reverse gate connecting rod 246.

It is this vast range of vertical and horizontal pivotal freedom of the various components used to extend and retract the reverse gate that makes it possible to link the reverse gate to the nozzle member so as to pivot laterally with it—particularly a nozzle member which pivots vertically as well to adjust or "trim" the attitude of the watercraft in the water. Consequently, because the reverse-direction thrust produced by the water being diverted by the reverse gate acts in a direction that is aligned with the axis of the nozzle member and that stays aligned with the axis of the nozzle member as the nozzle member pivots laterally, true steering response or control is enabled while travelling in a reverse direction.

As further illustrated in FIGS. 6–9, the reverse gate actuating bracket 144 has stop extensions 288 and 290, with each arm 146 of the reverse gate actuating bracket having a stop extension 290 at the lowermost end thereof and, in the illustrated embodiment, just one arm (e.g., the left arm, as shown in FIG. 3) having a stop extension 288. The stop extensions 288 and 290 limit the range of motion of the actuating bracket 144 and hence the range of vertical pivoting motion of the reverse gate 130. In particular, retraction of the reverse gate is limited by upper stop extension 288 butting up against the upper surfaces of stop protrusions 292 formed near the inlet end 127 of the venturi member 128 (one on either side), and extension of the reverse gate is limited by lower stop extensions 290 butting up against the lower surfaces of the stop protrusions 292.

Finally, in terms of the various components of the nozzle assembly and actuation of the reverse gate, tension spring 300 retains the reverse gate in either the retracted position or the extended position, as illustrated in FIGS. 6–9. In particular, the tension spring 300 is hook-mounted to and extends between spring mount post 302 extending from the venturi member 128 (near its inlet end 127) and spring mount post 304 extending from one arm 146 of the reverse gate actuating bracket 144. When the reverse gate is retracted, as shown in FIGS. 6 and 8, the tension axis of the spring is located above the axis about which the reverse gate actuating bracket pivots, i.e., the axis extending between pin support assemblies 140 and 142. Accordingly, when the reverse gate is retracted, the spring biases the reverse gate actuating bracket 144 in the counterclockwise direction (as shown in FIGS. 6 and 8), thereby securely holding the reverse gate in the retracted position. Conversely, when the reverse gate is extended, the angle of the spring shifts such that the tension axis is located slightly below the axis about which the reverse gate actuating bracket 144 rotates. Accordingly, when the reverse gate is extended, the spring biases the reverse gate actuating bracket in the clockwise direction (as shown in FIGS. 7 and 9), thereby securely holding the reverse gate in the extended position. A push-pull type reverse gate actuating linkage (not shown), which has sufficient rigidity to overcome the biasing force of the spring when the reverse gate is retracted and to push the reverse gate actuating bracket rearwardly, is pivotally attached (e.g., by a pin attachment) to the reverse gate actuating bracket 144 at actuating linkage attachment aperture 306.

In addition to the nozzle assembly and the actuation mechanism, we have made numerous improvements to the reverse gate 130, per se, which are illustrated in FIGS. 14–17. In particular, we have determined that, despite the provision of stators in the waterjet flow pathway downstream from the impeller, the jet of water exiting the nozzle member still has a vortical component of flow, i.e., a certain amount of vorticity or swirl in it. The direction of swirl will, of course, depend on the direction in which the impeller spins. For example, in SEA-DOO® brand watercraft manufactured by Bombardier, Inc. and incorporating the various aspects of the present invention, the waterjet swirls in a counterclockwise direction as viewed from the rear of the watercraft looking forward.

Figure 16:
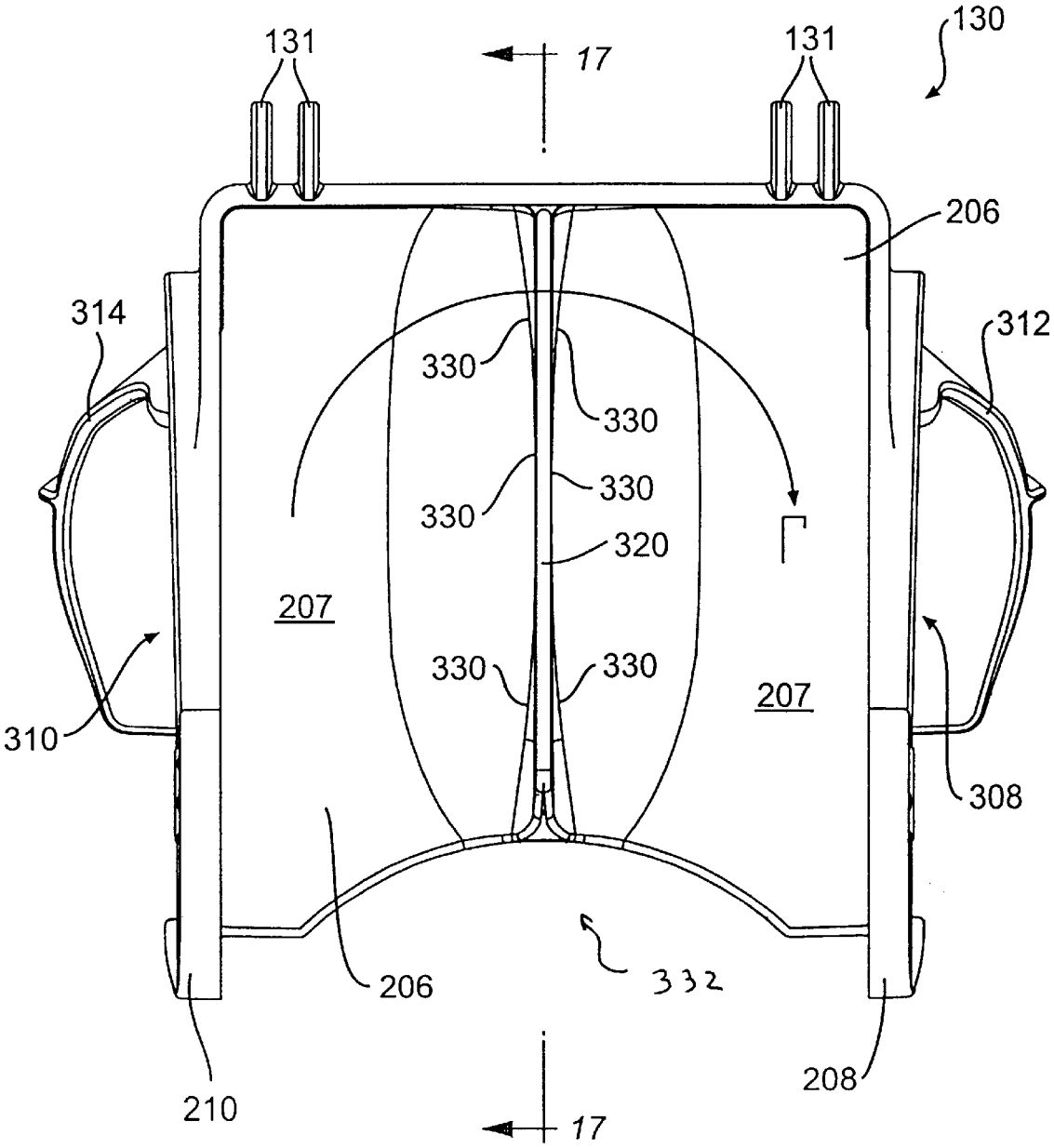
FIG. 16 is an end view of the reverse gate shown in FIG. 3 showing the inner-or upstream-facing, flow-diverting surface of the rear wall of the reverse gate.
Figure 17:
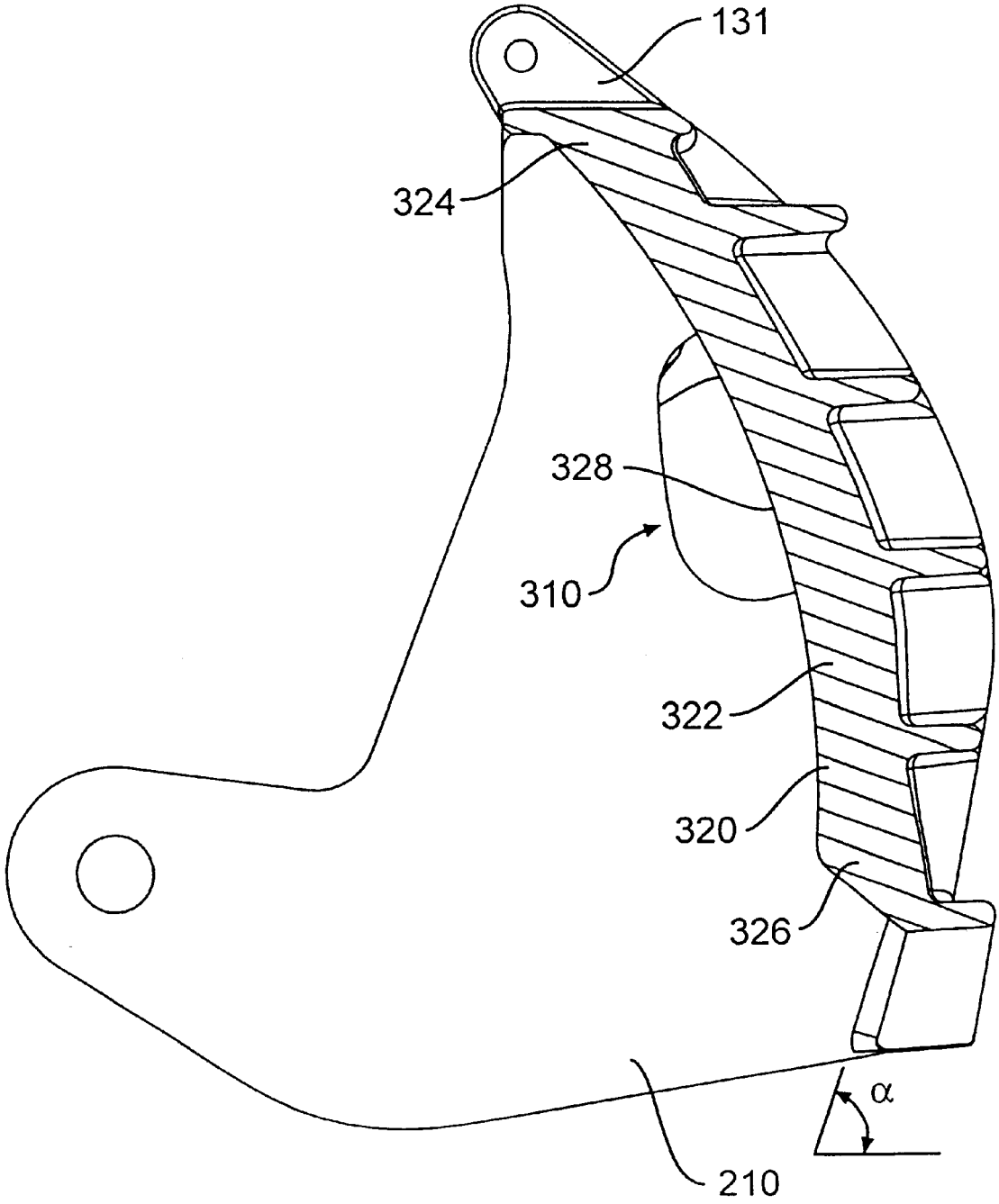
FIG. 17 is a section view taken along lines 17—17 in FIG. 16.

The reverse gate 130 incorporates a number of features which are designed to accommodate the vorticity or swirl in the flow and to optimize performance of the reverse gate with that vorticity present. In particular, the reverse gate is designed so that approximately half of the flow of water is deflected down and forward (as addressed in greater detail below) and the remainder is expelled through left and right flow vents 308 and 310, respectively. The flow vents are formed as apertures through the reverse gate mounting arms 208 and 210, respectively, near the junction of the mounting arms with the rear wall 206 of the reverse gate and approximately two-thirds to three-fourths of the way from the bottom of the rear wall of the reverse gate. As a result of the direction of swirl (counterclockwise as seen from the rear of the watercraft; clockwise as the flow impacts on the inner surface 207 of the rear wall 206 of the reverse gate, as shown in FIG. 16), the water swirls toward the left flow vent and therefore more water "wants" to exit through the left flow vent 308 than through the right flow vent 310; such differential flow through the vents ordinarily would result in different performance characteristics of the watercraft when backing up to the right as compared to backing up to the left. Therefore, in the reverse gate 130 of the invention, the cross-sectional area of the left flow vent 308 is made approximately 20% smaller than the cross-sectional area of the right flow vent 310, which results in substantially or approximately equal amounts of water flowing through the two different flow vents.

Additionally, the flow-directing flaps or "ears" 312 and 314 covering the left and right flow vents 308 and 310, respectively, are differentially configured. Because more water tends or "wants" to flow through the left flow vent 308 than the right flow vent 310 due to the direction of vorticity of the flow, as noted above, and more flow being expelled from one side of the reverse gate than the other would tend to create a larger thrust force on the one side than on the other, the right flow-directing flap 314 is angled more forward than the left flow-directing flap 312 so as to direct the flow of water being expelled through the right flow vent 310 more forward than the flow of water being expelled through the left flow vent 308, thereby balancing the forward component of thrust on each side of the reverse gate. (The flow vents 308 and 310 and flow-directing flaps 312 and 314 are configured so that the direction of the waterjets on both the left and right sides of the reverse gate is angled approximately 15–20° downward and is at essentially the same downward angle on both sides.)

The specific dimensions of the flow vents; their relative proportions; and the difference in the forward angular directions of the flow will vary depending on the specific watercraft operating parameters for which the reverse gate is being designed; in particular, the specific values are all functions of pump/impeller/stator efficiencies. In practice, the relative dimensions and/or the angles of the flow-directing flaps will be "tuned" to provide uniform right and left turning performance. This can be determined by measuring the amount of time it takes for the watercraft to complete a 360° turn when backing up to the right and backing up to the left and then adjusting the areas and/or the angles such that the watercraft takes the same amount of time to complete a left-turning reverse circle as it takes to complete a right-turning reverse circle.

The central rib 320 protruding from the inner surface 207 of the reverse gate and extending vertically along the lateral (i.e., left/right) line of symmetry (to the extent the reverse gate is, in general, symmetric) is also designed with the swirl or vorticity in the flow in mind. In general, the rib 320 is provided to ensure substantially uniform or even distribution or separation of water between the left and right sides of the reverse gate. It will be appreciated that although the nozzle member 122 does significantly or substantially turn the flow of water being expelled from the venturi member 128, there nonetheless will tend to be a greater amount of flow out of one side of the nozzle member 122 than out of the other because, given the relatively short length of the flow passageway through the nozzle member, not all flow will be turned from the axial direction of the venturi member to the axial direction of the nozzle member.

This consideration may be understood or appreciated more clearly from FIGS. 12 and 13. When the nozzle member 122 is pivoted all the way to the left, as shown in FIG. 12, the portion of flow through the right portion of the venturi member 128 (upper half of the venturi member as shown in FIGS. 12 and 13) will strike the inner surfaces of the right portion of the nozzle member and be deflected or diverted toward the left (i.e., down as shown in FIG. 12), and the turning pressure imparted by the right-hand inner surface of the nozzle member is sufficient to redirect the flow to the left. Even with the nozzle member deflected all the way to the left, however, given the relatively short length of the nozzle member, the portion of flow through the left half of the venturi member could still pass straight through the nozzle member without impinging on any of its inner surfaces. Thus, but for the turning or deflecting pressure imparted to the flow by virtue of the right portion of flow striking the inner surface of the right portion of the nozzle member, the left portion of flow exiting the venturi member would pass straight through the nozzle member without being turned. (In other words, when looking straight at the rear of the watercraft when the reverse gate is retracted and the nozzle member is pivoted completely to the left, as shown in FIG. 10, it is possible to see a substantial part of the left portion of the exit of the venturi member clearly through the outlet of the nozzle member.)

As a result, when the nozzle member is pivoted to the left and the reverse gate is extended, as shown in FIG. 12, more water will strike the right portion of the inner surface of the rear wall of the reverse gate than the left portion. Conversely and for the same reasons, when the nozzle member is pivoted to the right and the reverse gate is extended, as shown in FIG. 13, more water will strike the left portion of the inner surface of the rear wall of the reverse gate than the right. If the velocity and/or amount of water exiting the nozzle member is/are high enough, such difference in the amount of water impacting the two different sides of the reverse gate rear wall could cause the reverse gate/nozzle member to snap over sharply to a full lateral deflection, even when initially deflected only slightly.

The rib 320, however, helps to distribute or balance the relative volumes of water between the two halves of the reverse gate, thereby preventing such "hard over" lateral pivoting of the nozzle member as well as balancing the amount of water being expelled from the two sides of the reverse gate and helping to ensure uniform reverse turning performance of the watercraft. To that end, the central portion 322 of the rib protrudes sufficiently forward into the oncoming flow of water to cause flow separation between the right and left sides of the reverse gate, but it does not extend so far as to inhibit altogether balancing "cross-over" flow between the two sides of the reverse gate.

Additionally, the central portion 322 of the rib does not extend as far forward into the flow as the upper and lower portions 324 and 326, respectively, do. In particular, rather than extending straight across the surface 207 from the upper portion to the lower portion of the reverse gate, the leading edge 328 of the rib is arcuate or contoured so as to extend substantially parallel to or concentrically with the inner surface 207. This configuration—with the central portion 322 not protruding as far into the flow as would be the case if the leading edge 328 were a straight line—permits water to flow across the rib from one side of the reverse gate to the other so as to equalize or balance the amount of water in the two halves of the reverse gate, whereas if the leading edge were formed as a straight line such that the central portion of the rib protruded further upstream into the flow, such balancing or equilibrating cross-flow would be substantially inhibited.

Furthermore, as explained above, a certain amount of vorticity or swirl is present in the flow of water, and the vortical component of flow velocity is substantially larger at the radial outer portions of the waterjet than in the central portions of the waterjet. Accordingly, the amount of swirl to be reduced or eliminated is greater in the radial outer portions of the flow than in the more central portions of the flow. Because the upper and lower portions 324 and 326 of the rib protrude forwardly or upstream into the flow slightly more than the central portion 322 of the rib does, the upper and lower portions provide the desired increased swirl reduction in the radial outer portions of the flow.

Still further with respect to the design of the rib 320, the radius of curvature of the fillet portions 330 along either side of the rib, where the rib merges with the inner surface 207, is also critical. In general, and as a matter of good engineering practice, the fillets should provide a smooth transition for the flow passing over the surfaces of the rib and turning along the inner surface 207.

More specifically, by virtue of back pressure created in the flow, the radius of curvature of the fillets directly influences the operating point at which the waterjet impeller will begin to cause cavitation in the flow (i.e., the operating point at which increasing rotational velocity of the impeller no longer causes any significant increase in the outlet velocity or mass flow rate of the waterjet). If the fillet radius of curvature is too small and the transition from the rib surface to the rear wall inner surface is too abrupt, the amount of back pressure created in the flow will be relatively high and impeller cavitation will begin to occur at a relatively low rotational velocity, which will result in a lower waterjet flow rate and hence lower thrust in the reverse direction than might be desired. On the other hand, if the fillet radius of curvature is too large and the transition is too gradual, the point at which the impeller begins to cavitate when traveling in the reverse direction will be too high and greater reverse thrust than the operator is able to handle comfortably will result. Accordingly, the fillet radius of curvature should be selected such that impeller cavitation results at an impeller rotational speed that is below the point at which cavitation occurs when traveling in the forward direction, but which is not so low that unacceptably low reverse thrust is produced. For example, on SEA-DOO® brand watercraft of the sort employing the reverse gate assembly of the present invention, the impeller begins to cavitate at somewhere on the order of 6500–6800 rpm when the reverse gate is retracted (i.e., when traveling in the forward direction), whereas the impeller starts to cavitate at somewhere on the order of 4000–5000 rpm when the reverse gate is extended or lowered into the waterjet for reverse travel.

In addition to the fillet radius of curvature, the angle $\alpha$ which the lower half of the inner surface 207 (and, in particular, the lowermost edge of the inner surface 207) makes with respect to horizontal or vertical (see FIG. 17) also influences the reverse direction impeller cavitation operating point. If the angle $\alpha$ is too low and the lower edge of the inner surface 207 is too close to horizontal, the reverse gate will create too much back pressure in the flow and will "choke off" the normal water jet exit flow. On the other hand, if the angle $\alpha$ is too high and the lower edge is too close to vertical, reverse thrust will be lost. Additionally, there will be too little downward force on the lower edge of the rear wall of the reverse gate. In that case, upwardly acting forces caused by the water being expelled through the left and right flow vents 308 and 310 in the slightly downward direction (besides forward, as described above), along with the impact forces caused by the water striking the upper portions of the inner surface 207, will force the reverse gate up, and the tension spring 300 will automatically "snap" the reverse gate back into the retracted position. As is the case for the various reverse gate parameters discussed above, the specific angle $\alpha$ will depend on the specific size and water flow rates associated with the particular watercraft on which the invention is being employed. For SEA-DOO® brand watercraft of the sort to which the invention may be applied, the angle $\alpha$ (when the reverse gate is fully extended) is approximately 60°, and the configuration of the reverse gate actuation linkage assembly 240 is such that the angle $\alpha$ remains virtually constant as the nozzle member 122 pivots vertically with adjustment of the trim setting.

Finally, with respect to the reverse gate 130, the lower edge of the rear wall 206 is provided with an archway cutout 332. This archway cutout is provided so that the reverse gate does not obstruct the outlet jet of water when the reverse gate is retracted and the nozzle member is pivoted vertically upward to the full "nose up" trim position.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, the invention includes all modifications to and departures from the specific embodiments which are encompassed within the scope and spirit of the following claims.

We claim:

1. Pivotal apparatus, comprising:

a first pivoting member pivotal about a first pivot axis;

a second pivoting member pivotal about a second pivot axis spaced from said first pivot axis, said second pivot axis 1) being pivotable in a first plane that is parallel to said first pivot axis through a range of angles with respect to said first pivot axis; and 2) being movable in a direction normal or essentially normal to said first plane through a range of displacement distances relative to said first pivot axis; and an actuating linkage assembly connecting said first and second pivoting members such that pivoting of said first pivoting member about said first pivot axis effects driven pivoting of said second pivoting member about said second pivot axis, said actuating linkage assembly being configured such that said driven pivoting results for any angular position of said second pivot axis within said range of angles and for any displacement distance of said second pivot axis within said range of displacement distances.

2. The pivotal apparatus of claim 1, wherein said actuating linkage assembly comprises a first linkage member pivotally attached to said first pivoting member and pivoting about a first linkage member pivot axis that is spaced from and extends parallel to said first pivot axis; a second linkage member pivotally attached to said second pivoting member and pivoting about a second linkage member pivot axis that is spaced from and extends parallel to said second pivot axis; and a connecting member extending between and connecting said first and second linkage members, said connecting member being pivotally connected to said first linkage member at a first pivot point and being pivotally connected to said second linkage member at a second pivot point.

3. The pivotal apparatus of claim 2, wherein said first pivot point is spaced from said first linkage member pivot axis and said second pivot point is spaced from said second linkage member pivot axis.

4. The pivotal apparatus of claim 1, wherein said second pivot axis moves arcuately in a displacement arc which lies in a second plane that is orthogonal to said first plane, tangents to said displacement arc being normal or essentially normal to said first plane.

5. The pivotal apparatus of claim 4, wherein said first pivot axis is provided by means of a first-pivoting-member-carrying structure and said second pivot axis is provided by means of a second-pivoting-member-carrying structure and wherein said second-pivoting-member-carrying structure is gimbaled relative to said first-pivoting-member-carrying structure.

6. The pivotal apparatus of claim 1, 2, 3, 4, or 5, wherein said pivotal apparatus comprises a nozzle assembly capable of reversing a travelling direction of a waterjet-propelled watercraft, said first pivoting member comprises a reverse gate actuating bracket, and said second pivoting member comprises a reverse gate.

7. Pivotal apparatus, comprising:

a first pivoting member pivotal about a first pivot axis;

a second pivoting member pivotal about a second pivot axis spaced from said first pivot axis, said second pivot axis pivoting in a first plane that is parallel to said first pivot axis through a range of angles with respect to said first pivot axis; and an actuating linkage assembly connecting said first and second pivoting members such that pivoting of said first pivoting member about said first pivot axis effects driven pivoting of said second pivoting member about said second pivot axis, said actuating linkage assembly being configured such that said driven pivoting results for any angular position of said second pivot axis within said range of angles, said actuating linkage assembly comprising a first linkage member pivotally attached to said first pivoting member and pivoting about a first linkage member pivot axis that is spaced from and extends parallel to said first pivot axis; a second linkage member pivotally attached to said second pivoting member and pivoting about a second linkage member pivot axis that is spaced from and extends parallel to said second pivot axis; and a connecting member extending between and connecting said first and second linkage members, said connecting member being pivotally connected to said first linkage member at a first pivot point and being pivotally connected to said second linkage member at a second pivot point.

8. The pivotal apparatus of claim 7, wherein said first pivot point is spaced from said first linkage member pivot axis and said second pivot point is spaced from said second linkage member pivot axis.

9. The pivotal apparatus of claim 7, wherein said first pivot axis is provided by means of a first-pivoting-member-carrying structure and said second pivot axis is provided by means of a second-pivoting-member-carrying structure and wherein said second-pivoting-member-carrying structure is gimbaled relative to said first-pivoting-member-carrying structure.

10. The pivotal apparatus of claim 7, 8, or 9, wherein said pivotal apparatus comprises a nozzle assembly capable of reversing a travelling direction of a waterjet-propelled watercraft, said first pivoting member comprises a reverse gate actuating bracket, and said second pivoting member comprises a reverse gate.

* * * * *